US005528788A

United States Patent [19]

Yamamoto et al.

[11] Patent Number: 5,528,788

[45] Date of Patent: Jun. 25, 1996

[54] PROCESSING DEVICE FOR SHEET-LIKE MEDIA

[75] Inventors: Takuji Yamamoto, Toyokawa; Kouji Yamomoto, Shinshiro; Keizo Nishiguchi; Masahiro Yoshida, both of Toyokawa; Haruhiko Atarashi, Fujiidera, all of Japan

[73] Assignee: Minolta Co., Ltd., Osaka, Japan

[21] Appl. No.: 469,857

[22] Filed: Jun. 6, 1995

[30] Foreign Application Priority Data

Jun. 17, 1994 [JP] Japan ..... 6-135588

[51] Int. Cl.[6] ..... B08B 3/08

[52] U.S. Cl. ..... 15/77; 15/88.3; 134/57 R; 134/64 R; 134/122 R

[58] Field of Search ..... 15/3, 21.1, 77, 15/88.2, 88.3, 97.1, 100, 102; 134/57 R, 64 R, 122 R

[56] References Cited

U.S. PATENT DOCUMENTS

| | | | |
|---|---|---|---|
| 2,259,260 | 10/1941 | Matteson et al. | 15/77 |
| 3,694,071 | 9/1972 | Touchette | 15/77 |
| 3,792,503 | 2/1974 | Brock | 15/77 |
| 4,428,659 | 1/1984 | Howard | 15/77 |
| 5,400,123 | 3/1995 | Sato et al. | 134/122 R |

FOREIGN PATENT DOCUMENTS

| | | |
|---|---|---|
| 4-91298 | 3/1992 | Japan . |
| 4-300395 | 10/1992 | Japan . |

*Primary Examiner*—David Scherbel
*Assistant Examiner*—Terrence R. Till
*Attorney, Agent, or Firm*—Willian Brinks Hofer Gilson & Lione

[57] ABSTRACT

A processing device for processing sheet-like media via immersion in a special fluid, for example, for renewing a copy sheet by removing printed material such as toner therefrom. The processing device has a tank accommodating a fluid therein; a sheet feeding device for feeding a sheet into the fluid in the tank, a sheet accommodating device for accommodating a sheet, a sensing device for outputting a signal responsive to a state of the sheet in the sheet accommodating device, and a changing device for changing a relative position between the tank and the sheet accommodating device, the relative position including a retracted position where the sheet accommodating device is positioned outside the tank and an operating position where the sheet accommodating device is positioned within the fluid in the tank, the changing device changing the relative position in response to the signal outputted by the sensing device. The processing device permits a jammed sheet to be easily removed from the device, usually without it being necessary for an operator to touch the fluid in the tank.

9 Claims, 27 Drawing Sheets

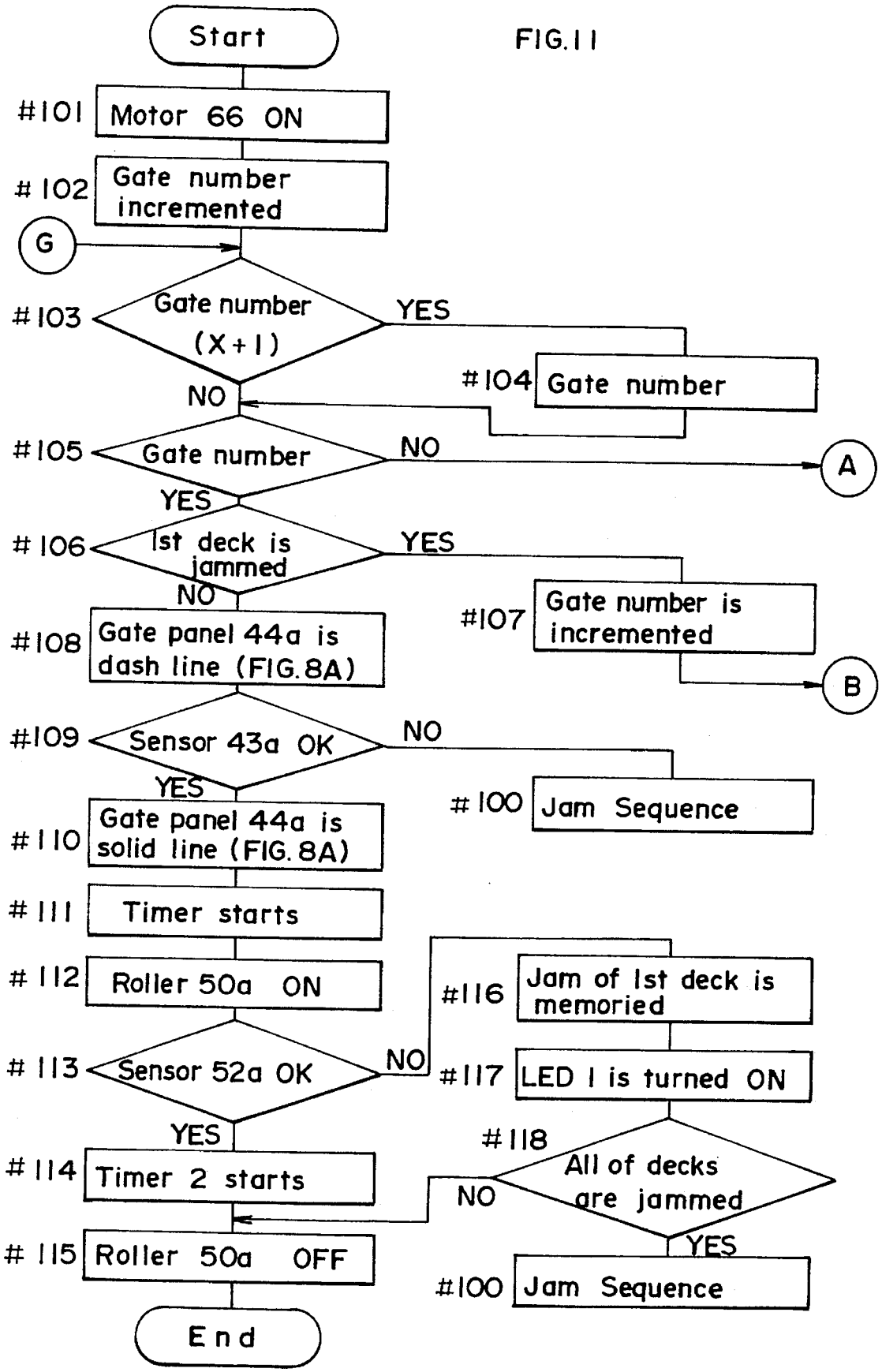
FIG. 11
Start
#101 Motor 66 ON
#102 Gate number incremented
G
#103 Gate number (X+1)
YES
#104 Gate number
NO
#105 Gate number
NO
A
YES
#106 1st deck is jammed
YES
#107 Gate number is incremented
B
NO
#108 Gate panel 44a is dash line (FIG. 8A)
#109 Sensor 43a OK
NO
#100 Jam Sequence
YES
#110 Gate panel 44a is solid line (FIG. 8A)
#111 Timer starts
#112 Roller 50a ON
#113 Sensor 52a OK
NO
#116 Jam of 1st deck is memoried
#117 LED 1 is turned ON
YES
#114 Timer 2 starts
#118 All of decks are jammed
NO
YES
#115 Roller 50a OFF
#100 Jam Sequence
End E
#X05
Gate number : X
YES
#X06
Xth deck is jammed
F
YES
NO
#X08
Gate panel X is dash line
#X07
Gate number is incremented
G
#X09
Sensor 43x is OK
NO
YES
#100
Jam Sequence
#X10
Gate panel X is solid line
#X11
Timer X starts
#X12
Roller 50x ON
#X16
Jam of Xth deck is memoried
#X13
Sensor 52x OK
NO
YES
#X17
LED X is turned ON
#X14
Timer X starts
#X18
All of decks are jammed
NO
YES
#X15
Roller 50x OFF
#100
Jam Sequence
End

PROCESSING DEVICE FOR SHEET-LIKE MEDIA

BACKGROUND OF THE INVENTION

1. Field of the Invention

The present invention relates generally to a processing device for processing sheet-like media; and, more particularly, to a processing device for processing sheet-like media via immersion in a special fluid such as a deinking fluid.

2. Description of the Prior Art

One well-known mode of a processing device for processing sheet-like media via immersion in a special fluid comprises a device which recycles a sheet, such as a copy paper, bearing a toner image formed thereon by immersion of the sheet in a toner-dissolving solvent or a toner stripping fluid so as to remove the toner from the sheet.

In such a device, the risk of a sheet jam when processing a copy paper sheet is unavoidable, particularly because the strength of the sheet is reduced as a result of its being immersed in the fluid. In such instances, the jammed sheet typically must be removed from the fluid, and this presents the disadvantage that an operator must immerse his or her hand in the fluid in order to retrieve the jammed sheet.

SUMMARY OF THE INVENTION

The present invention provides a processing device for processing sheet-like media via immersion in a fluid which facilitates the removal of jammed sheets without, so far as possible, requiring immersion of a hand of an operator in the fluid.

A processing device according to the present invention includes a tank accommodating a fluid therein, sheet feeding means for feeding a sheet into the fluid in the tank, a sheet accommodating device for accommodating a sheet, sensing means for outputting a signal responsive to a state of the sheet in the sheet accommodating device, and changing means for changing a relative position between the tank and the sheet accommodating device, the relative position including a retracted position where the sheet accommodating device is positioned outside the tank and an operating position where the sheet accommodating device is positioned within the fluid in the tank, the changing means changing the relative position in response to the signal outputted by the sensing means.

In accordance with the present invention, the sheet accommodating device, which carries a sheet being processed, is relatively movable with respect to the tank accommodating the fluid therein between an operating position within the fluid in the tank and a retracted position outside the tank. Accordingly, when a sheet jam or the like occurs in the device, the jammed sheet can usually be removed without it being necessary for an operator to immerse his or her hand in the fluid in the tank by moving the sheet accommodating device to the retracted position outside the fluid tank.

According to a presently preferred embodiment, the processing device comprises a copy sheet recycling device for renewing a sheet formed of paper or resin film by removing printed material such as toner or the like therefrom.

Yet further advantages and specific details of the invention will become apparent hereinafter in conjunction with the following detailed description of presently preferred embodiments.

BRIEF DESCRIPTION OF THE DRAWINGS

FIGS. 11–14 is a flow chart for continuing processing without a deck having a jammed sheet when a jam occurs in the sheet processing section;

DETAILED DESCRIPTION OF THE PREFERRED EMBODIMENTS

Figure 1:
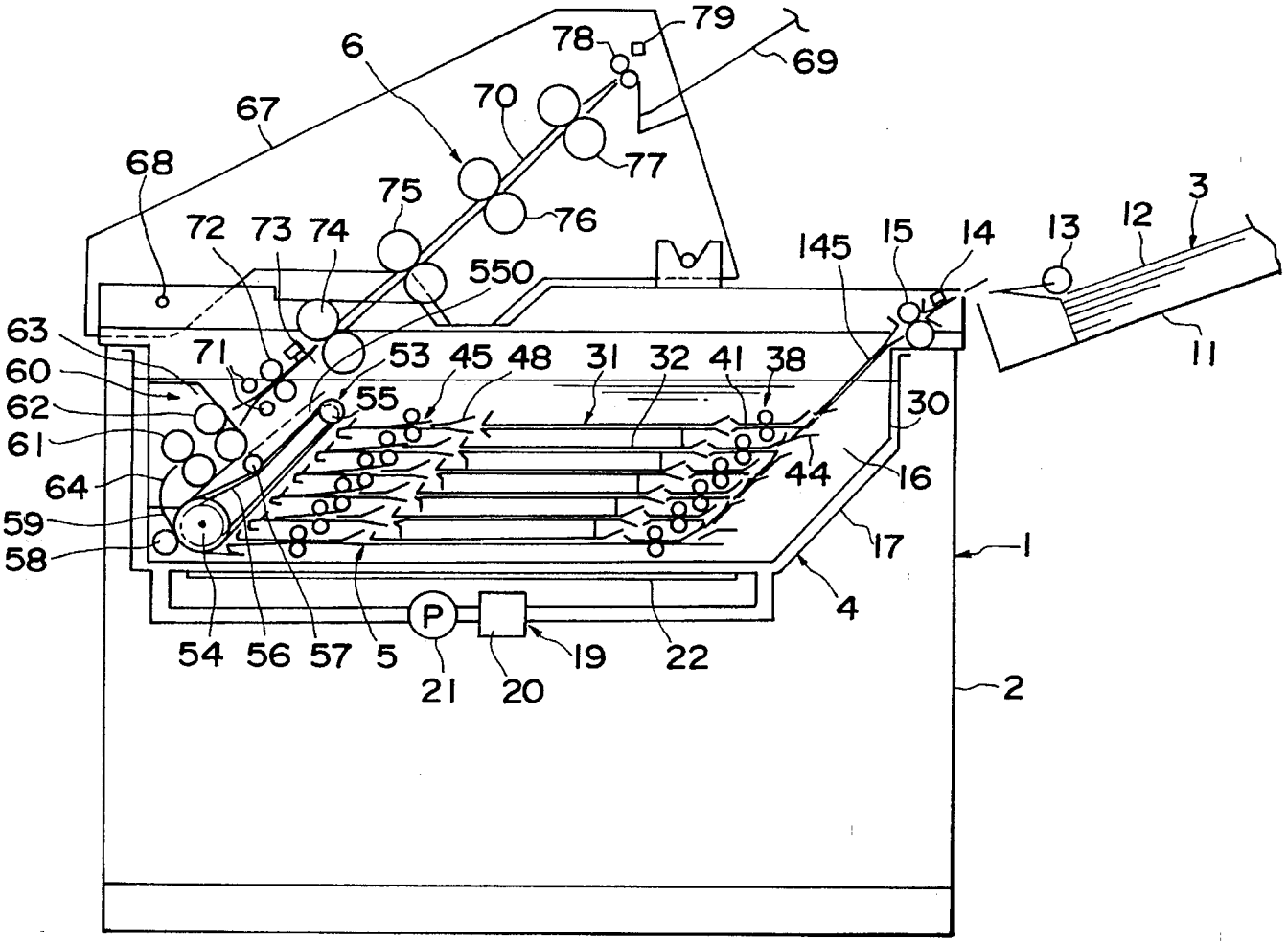
FIG. 1 is a sectional view illustrating a processing device according to a presently preferred embodiment of the invention with a fluid tank thereof in an operating position.

FIG. 1 illustrates a processing device for processing sheet-like media according to a presently preferred embodiment of the invention. More particularly, FIG. 1 illustrates a processing device in the form of a copy sheet recycling device 1 for renewing a sheet formed of paper or resin film by removing printed material such as toner or the like therefrom.

Copy sheet recycling device 1 generally includes a main frame 2, a sheet feeding section 3 for feeding copy sheets to be processed one sheet at a time, a fluid accommodating device 4 containing a deinking fluid for removing printed material, i.e., toner, printed on a copy sheet, a sheet processing section 5 for immersing a copy sheet in the deinking fluid, and a discharge section 6 for drying sheets removed from the deinking fluid.

The sheet feeding section 3 includes a cassette 11 which accommodates a stack of used copy sheets 12, such as a copy paper, which have previously been subjected to copy processing. Sheet feeding section 3 further includes a feed roller 13 for feeding stacked copy sheets 12 one sheet at a time from the cassette 11, a sheet detection sensor 14 for detecting fed sheets, and a timing roller 15 for regulating the timing for supplying copy sheets 12 to sheet processing section 5.

The fluid accommodating device 4 includes a fluid tank 17 which accommodates a special deinking fluid 16 (which will be described in detail hereinafter) for stripping toner fixed on a copy sheet 12. Fluid tank 17 is vertically movable between an operating position shown in FIG. 1, and a retracted position shown in FIG. 2 via a lifting mechanism 18 (refer to FIG. 3). Fluid tank 17 is provided with a fluid circulation device 19 which includes a collection member 20, such as a filter or the like, and a pump 21 for collecting the toner removed from a sheet 12. A fluid heater 22 is provided on the bottom of fluid tank 17 to maintain the deinking fluid 16 at an optimum temperature.

Figure 2:
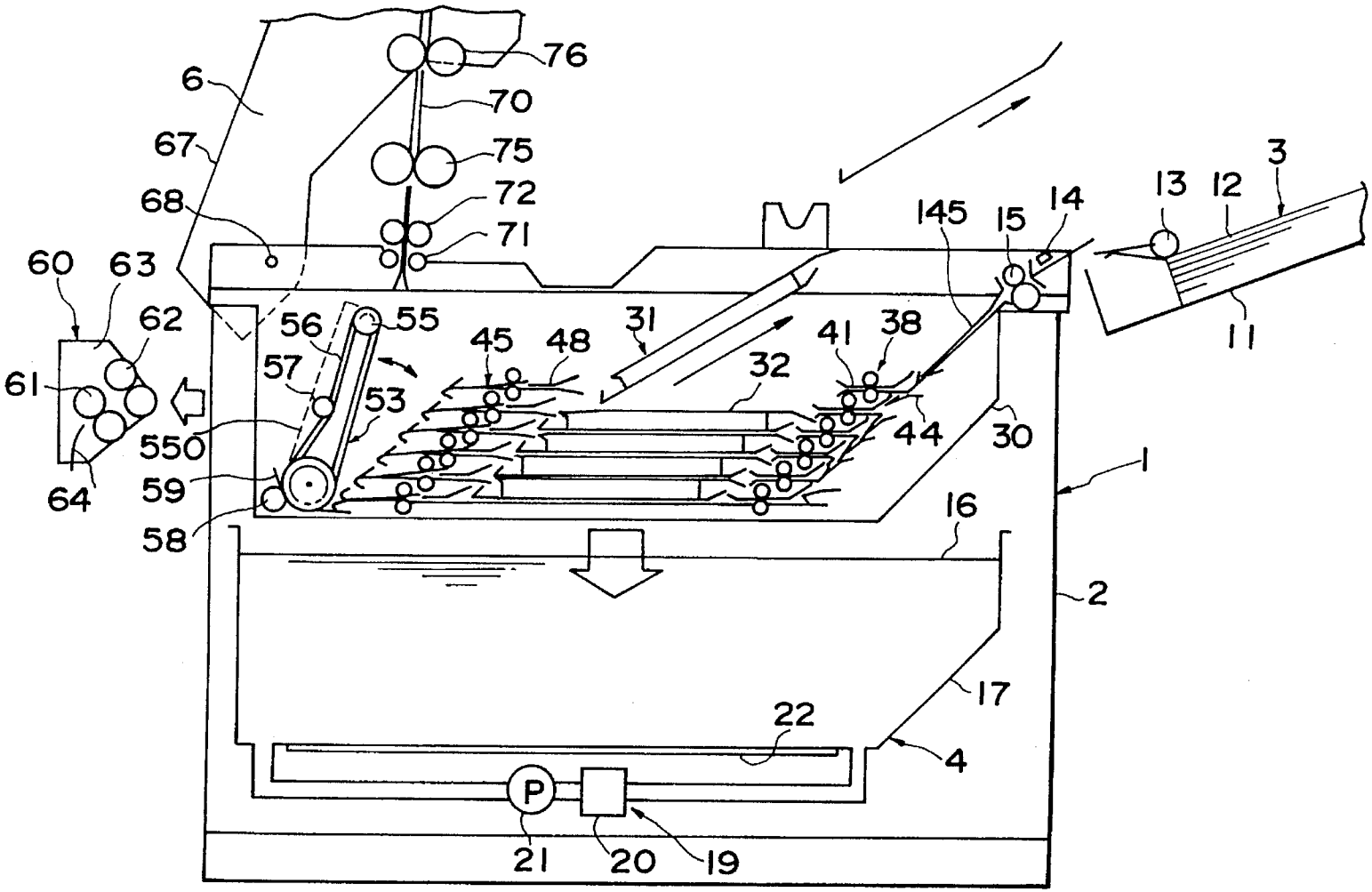
FIG. 2 is a sectional view illustrating the processing device of FIG. 1 with the fluid tank thereof in a retracted position.
Figure 3:
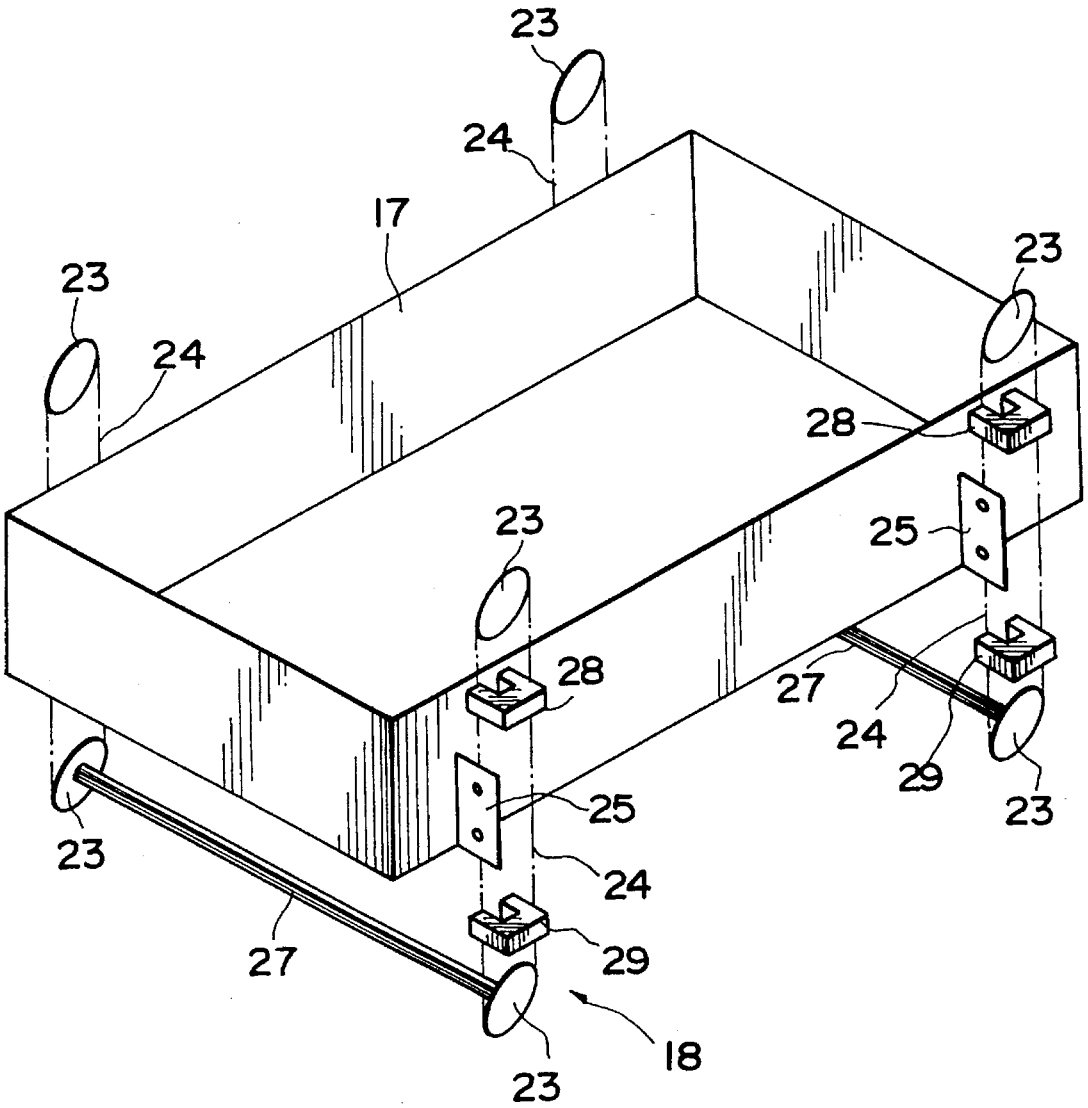
FIG. 3 is a perspective view illustrating a lifting mechanism of the fluid tank.
Figure 4:
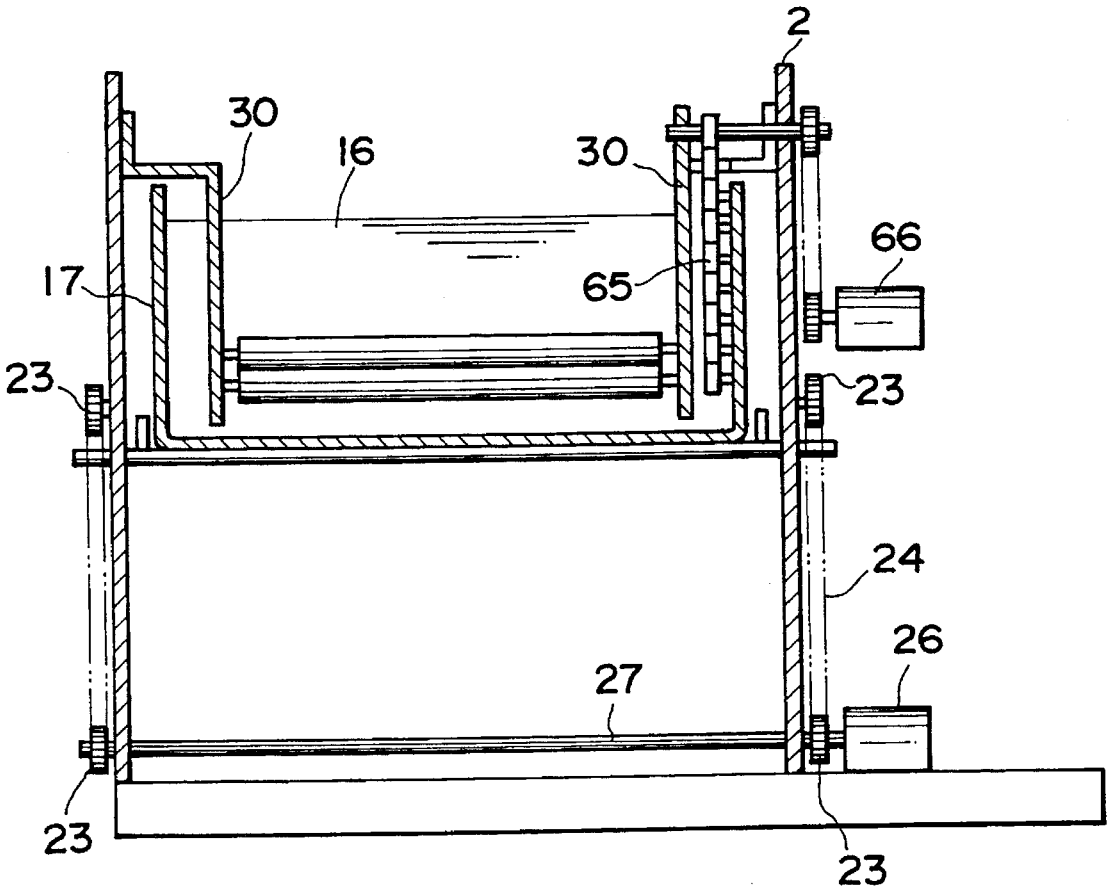
FIG. 4 is a sectional view illustrating the lifting mechanism and the fluid tank at the operating position of FIG. 1.
Figure 5:
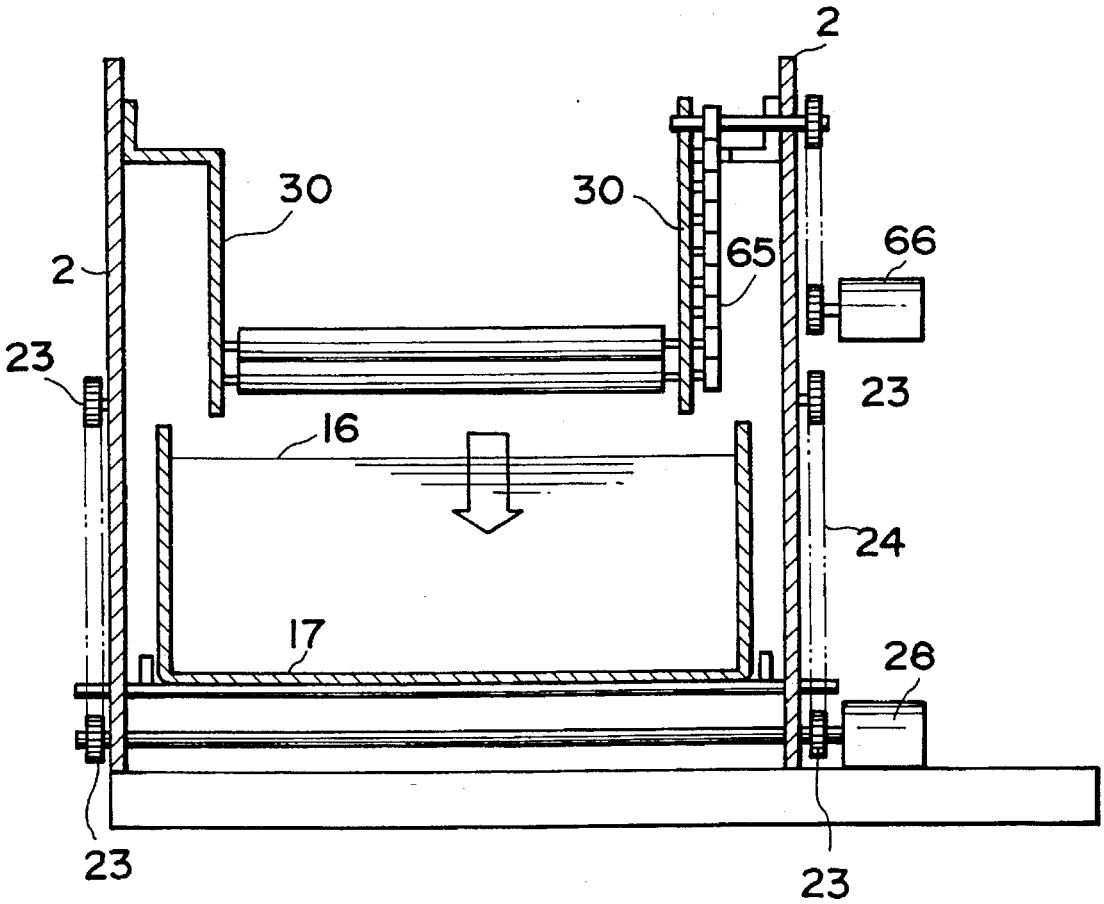
FIG. 5 is a sectional view illustrating the lifting mechanism and the fluid tank at the retracted position of FIG. 2.

With reference to FIGS. 3–5, lifting mechanism 18 includes a plurality of pairs of sprocket wheels 23 disposed at the anterior and posterior right and left sides of main frame 2. A chain 24 is looped around each of the pairs of sprocket wheels 23, and each chain is connected to fluid tank 17 via a stationary panel 25. The lower sprocket wheels of each of two pairs of sprocket wheels 23 are connected together by shafts 27, which are drivably connected to a motor 26. Accordingly, when shafts 27 are rotated by the drive force of the motor 26, sprocket wheels 23 are also rotated to drive the chains 24 to raise and lower fluid tank 17, so that the tank is selectively switchable between the operating position shown in FIG. 1 and FIG. 4 and the retracted position shown in FIG. 2 and FIG. 5.

At the top and bottom of fluid tank 17 are respectively provided upper limit sensors 28 and lower limit sensors 29, such that movement of fluid tank 17 to the operating position and the retracted position is verifiable by means of the sensors.

The sheet processing section 5 includes a sheet accommodating section 31 disposed medially between a pair of guide frames 30 bilaterally disposed relative to the sheet transport path. The sheet accommodating section 31 is used for immersion of a supplied sheet in the deinking fluid 16 for a predetermined period of time.

Figure 6:
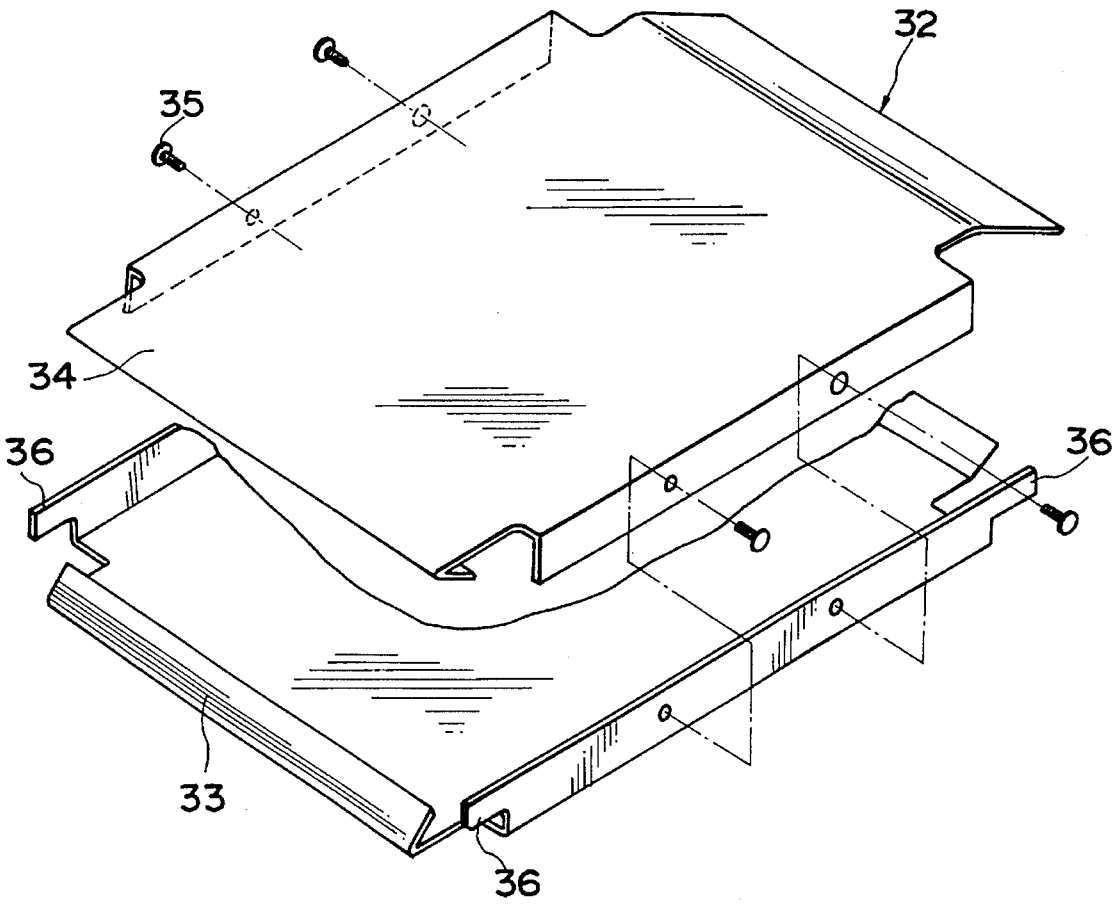
FIG. 6 is a perspective view illustrating guides forming decks of a sheet accommodating section of the device of FIGS. 1 and 2.
Figure 7:
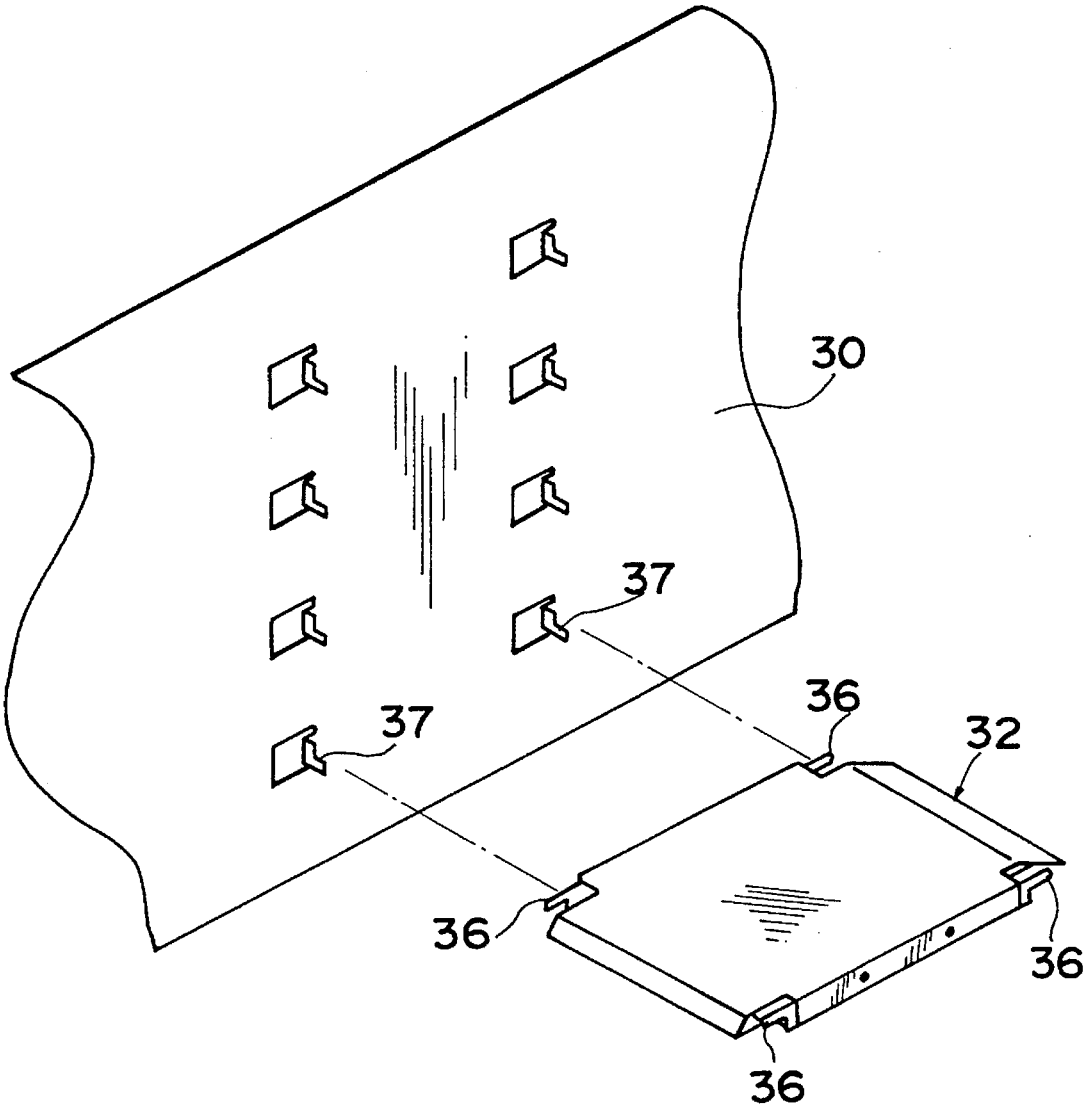
FIG. 7 is a perspective view illustrating mountings of the decks relative to guide frames.

Sheet accommodating section 31 includes a plurality of decks 32 vertically superimposed one over another to define a plurality of chambers for receiving supplied sheets. Each deck 32 (see FIG. 6) comprises a top guide 33 for guiding the top surface of a sheet, and a bottom guide 34 for guiding the bottom surface of a sheet. The top guide 33 is disposed below the bottom guide 34 and is connected thereto by machine screws 35 or the like. Guides 33 and 34 are integratedly formed as a single unit, such that bilateral anterior and posterior members 36 provided on top guide 33 are supported so as to be freely engageable and disengageable relative to connector members 37 which protrude from guide frames 30, as shown in FIG. 7.

Figure 8A:
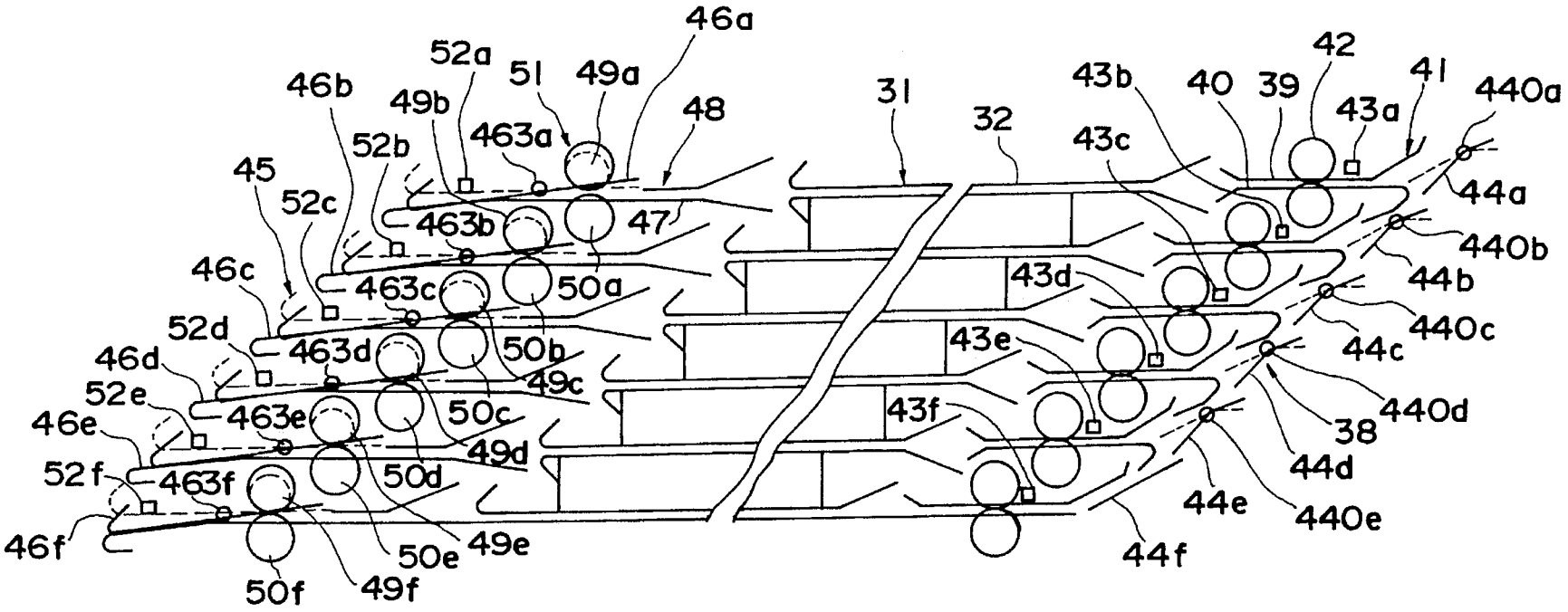
FIG. 8A is a sectional view illustrating the sheet accommodating section, a guide section, and a refeeding section in a sheet processing section of the device of FIGS. 1 and 2.

As shown in FIG. 8A, a guide member 38 is provided on the paper feed side of sheet accommodating section 31 so as to guide a sheet 12 fed from feeding section 3 to fluid tank 17 into the various levels of decks 32. As also shown in FIG. 8A, each level of decks 32 is provided with a plurality of guide decks 41 comprising a top guide 39 and a bottom guide 40. Pairs of sheet feeding rollers 42 and sheet detection sensors 43*a*–43*f* are provided in the vicinity of each guide deck 41. Also, at the entrance to each guide deck 41, gate panels 44*a*–44*f* are provided to guide sheets 12 to the respective guide decks 41. Gate panels 44*a*–44*e* are movable between the solid line position (nonguiding position) and the dashed line position (guiding position) in FIG. 8A. Gate panel 44*f*, however, is fixedly mounted at the guiding position relative to the lowermost guide deck 41.

Guide panels 145 (refer to FIG. 1) are also provided for guiding sheets 12 fed from feeding section 3 to the respective gate panels 44.

Figure 8B:
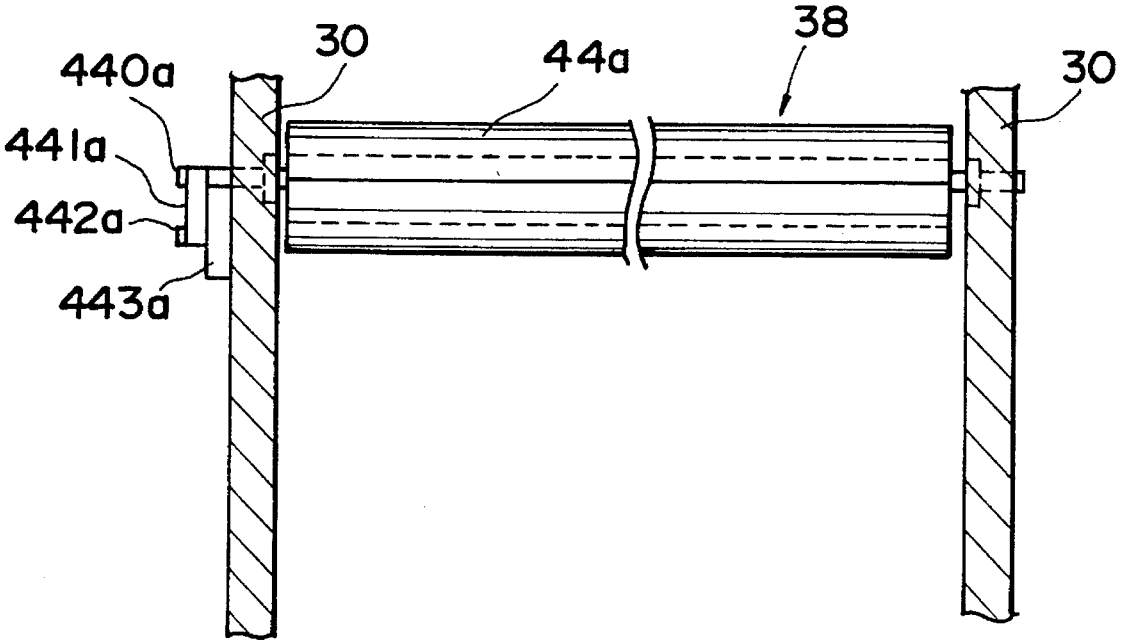
FIG. 8B illustrates the relationship of the guide section and a frame.

FIG. 8B illustrates the mechanism for moving each gate panel 44*a*–44*e*. Although only gate panel 44*a* is shown in FIG. 8B, it is to be understood that each of gate panels 44*b*–44*e* has basically the same construction as gate panel 44*a*, and the following description is, therefore, given with respect to gate panel 44*a* only.

Shaft 440*a* which is of a pinion gear type is integratedly mounted on gate panel 44*a* such that gate panel 44*a* is movable between the dashed line position and the solid line position shown in FIG. 8A via the rotation of the shaft 440*a*. On the other hand, motor 443*a* is mounted on frame 30 and is used to rotatably drive pinion gear shaft 442*a* in response to signals output from a central processing unit (CPU) of a control device to be described later. Shaft 440*a* and shaft 442*a* are connected via a belt 441*a* which has a toothed rack formed on its interior side. Motor 443*a* rotates in response to instructions from the CPU, such that gate panel 44*a* is moved between the solid line position and the dashed line position shown in FIG. 8A via the pinion gear and belt mechanism.

A refeeding section 45 is provided on the paper discharge side of accommodating section 31 to discharge sheet 12 from the various deck levels 32. Refeeding section 45 is provided with refeeding decks 48 comprising top guides 46*a*–46*f* and bottom guides 47 for each deck level 32. The respective top guides 46*a*–46*f* are movable between a solid line position (closed position) and a dashed line position (refeeding position). A pair of transport rollers 51 comprising top rollers 49*a*–49*f* and bottom rollers 50*a*–50*f* are provided for each refeeding deck 48 as a transport means for refeeding sheets 12 inserted between the guides 46*a*–46*f* and 47. Bottom rollers 50*a*–50*f* are stationary, while top rollers 49*a*–49*f* are fixedly mounted to respective top guides 46*a* to 46*f* so as to be separated from bottom rollers 50*a*–50*f* when the top guides 46*a*–46*f* are at the solid line position, and to be in contact with the bottom rollers 50*a*–50*f* when top guides 46*a*–46*f* are at the dashed line position.

Figure 8C:
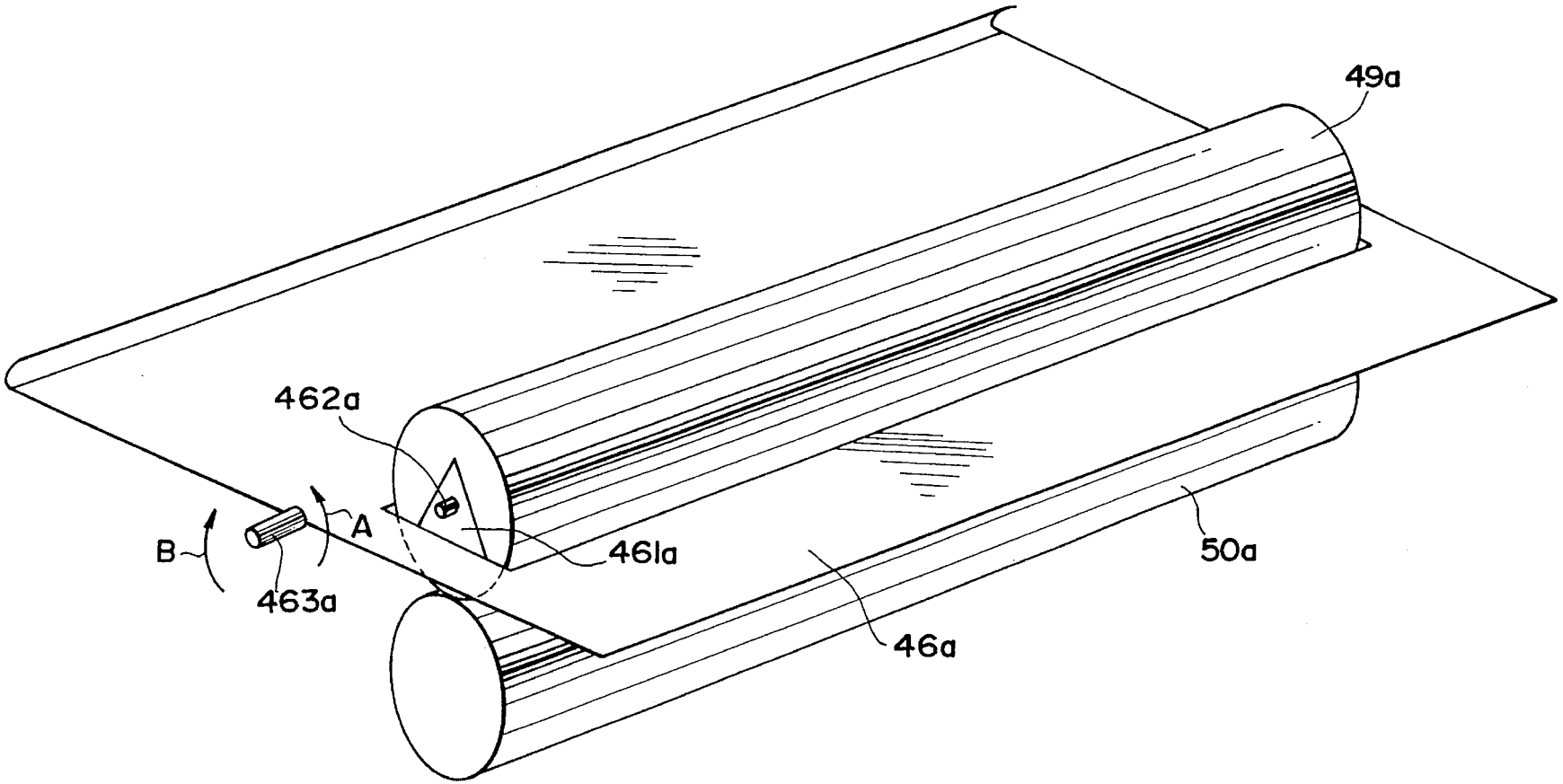
FIG. 8C is a perspective view illustrating the mountings of a top guide and a top roller.

FIG. 8C is a perspective view showing the state wherein top rollers 49*a*–49*f* and top guides 46*a*–46*f* are integratedly mounted. The construction of each of rollers 49*a*–49*f* and each of top guides 46*a*–46*f* is similar such that only roller 49*a* and top guide 46*a* are shown in FIG. 8C.

Guide 46*a* is provided with a shaft receiving member 461*a* mounted perpendicular to the guide 46*a*. Shaft 462*a* of roller 49*a* is supported by the shaft receiving member 461*a*. Roller 50*a* is rotatably driven by a gear mechanism 65 (FIGS. 4 and 5), and roller 49*a* rotates by being driven by the roller 50*a*. Shaft 463*a* is integratedly mounted on guide 46*a*, and is rotatable in both the direction of arrow A and the direction of arrow B shown in FIG. 8C. Rotation in the arrow A direction moves guide 46*a* from the dashed line position to the solid line position in FIG. 8A, and rotation in the arrow B direction moves guide 46*a* from the solid line position to the dashed line position.

Figure 8D:
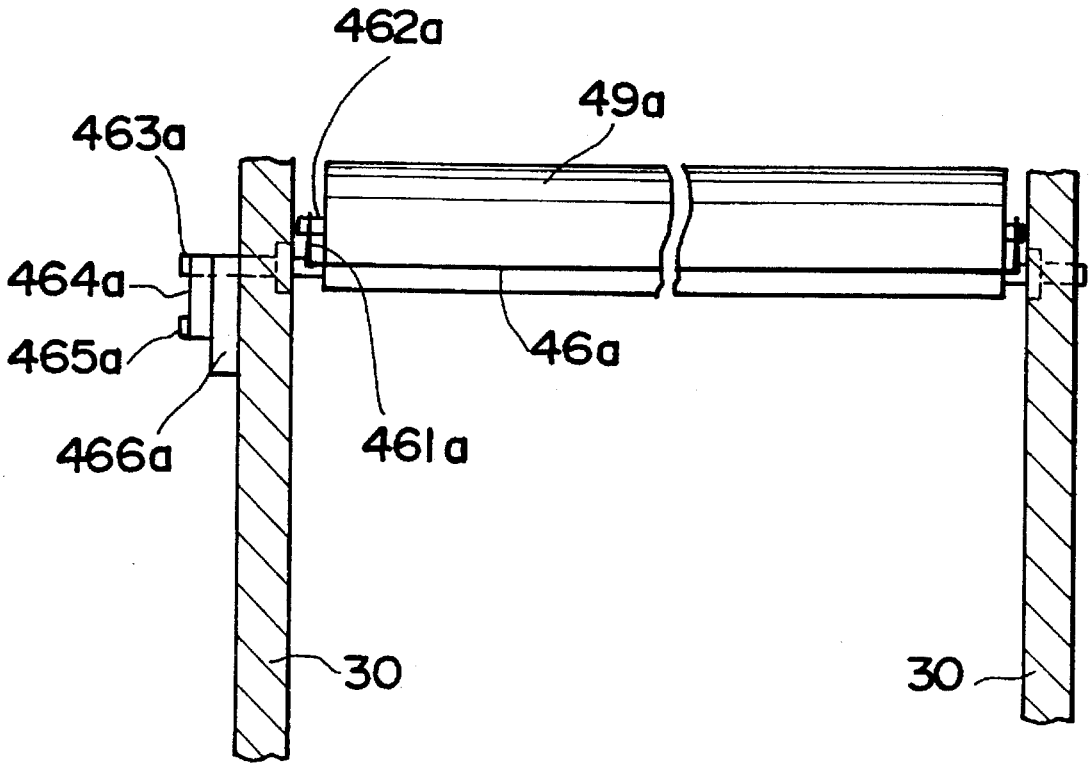
FIG. 8D illustrates the relationship between the refeeding section and the frame.

FIG. 8D shows the mounting relationship between frame 30 and guides 46*a*–46*f*. Although FIG. 8D only shows the relationship between guide 46*a* and frame 30, it is to be understood that since guides 46*b*–46*f* have basically the same construction as guide 46*a*, the following description is given in terms of guide 46*a* only.

Guide 46*a* is mounted so as to be movable between the solid line position and the dashed line position in FIG. 8A via the rotation of shaft 463*a* which is engaged with a pinion gear. On the other hand, motor 466*a*, which rotates pinion shaft 465*a* in response to signals output by a control CPU to be described later, is mounted on frame 30. Shaft 463*a* and shaft 465*a* are rotated by belt 464*a* which has a toothed rack formed on its interior side. Guide 46*a* is moved between the solid line position and the dashed line position in FIG. 8A with the rotation of motor 466*a* via the aforesaid mechanism.

Sheet detection sensors 52*a*–52*f* are provided in the vicinity of top guides 46*a*–46*f* to detect a sheet 12 discharged from the various refeeding decks 48.

Returning to FIG. 1, belt transport section 53 is provided on the side opposite sheet accommodating section 31 with refeeding section 45 interposed therebetween. Belt transport section 53 comprises a large-diameter grooved roller 54 disposed adjacent the lowermost refeeding deck 48, a small-diameter grooved roller 55 supported on a pair of frames 550 oscillatably provided on the support shaft of the grooved roller 54, a plurality of belts 56 reeved around the grooved rollers 54 and 55, and a tension roller 57 for regulating the tension of the belts 56. The belt transport section 53 is freely oscillatable by pivoting on the center shaft of large-diameter grooved roller 54 (refer to FIG. 2). Transport roller 58 and guide panel 59 are provided on the exterior side of large-diameter grooved roller 54, such that sheets 12 discharged from refeeding section 45 are fed to brush roller unit 60 along the guide panel 59 in accordance with the rotation of the transport roller 58 in conjunction with the movement of the belts 56.

Brush roller unit 60 comprises two pairs of brush rollers 61 and 62, a pair of frames 63 which bilaterally support the brush rollers, and a guide panel 64 for guiding a sheet to the pair of brush rollers 61. Brush roller unit 60 is integratedly removably installed relative to guide frame 30 as schematically illustrated in FIG. 2.

The various rollers of sheet processing section 5 having the above-described construction are connected to a motor 66 via a gear mechanism 65 or the like provided at the exterior side of guide frames 30, as shown in FIGS. 4 and 5. Thus, the rollers are rotatable in predetermined directions in conjunction with the drive supplied by the motor 66.

Returning to FIG. 1, the previously mentioned discharge section 6 is provided with a top frame 67. Top frame 67 is freely oscillatable relative to main frame 2 by pivoting on a shaft 68, and discharge tray 69 is provided at the free end thereof to accommodate processed sheets. Sheet transport path 70 is formed on the interior side of top frame 67 by a plurality of guide panels so as to guide sheets 12 transported from sheet processing section 5 to discharge tray 69. Furthermore, provided on the side of sheet transport path 70 are fluid spray nozzles 71 and 71 which face from the upstream side to the downstream side in the sheet transport direction for spraying deinking fluid 16 on both surfaces of a sheet 12 introduced into sheet transport path 70, intermediate rollers 72 disposed within deinking fluid 16 in the operating state to remove sheet 12 from within the deinking fluid, an insertion sensor 73 for detecting passage of sheet 12 between the intermediate rollers 72, squeezing rollers 74 for physically extracting deinking fluid 16 contained in sheet 12, three drying rollers 75, 76, 77 of the built-in heater type for thermally drying sheet 12, discharge rollers 78 for ejecting sheet 12 to discharge tray 69, and a discharge sensor 79 for detecting an ejected sheet 12 in discharge tray 69.

The operation of the recycling device 1 will now be described. Copy sheets 12 to be processed by the recycling device 1 are stacked in cassette 11. Stacked sheets 12 are fed one sheet at a time in accordance with the rotation of feed roller 13. After the leading edge of a sheet 12 is detected by feed sensor 14, the sheet 12 is transported by timing roller 15 to sheet processing section 5 via guide panel 145, and is immersed in deinking fluid 16.

Sheet 12 fed to sheet processing section 5 is transported to a corresponding deck level 32 distributed among predetermined guide decks 41 by gates 44*a*–44*f* at insertion section 38 via the drive action of motors 443*a*–443*f* in accordance with signals output from a CPU to be described later. For example, in the present embodiment, sheet 12 is transported from the uppermost guide deck 41 to sequentially lower guide decks 41. At this time, transport rollers 49 and 50 of refeeding deck 48 are separated, such that the leading edge of sheet 12 is inserted therebetween. Sheet 12 is held in a deck level 32 for a predetermined time, during which interval toner adhering to the sheet 12 swells, a portion is stripped from the sheet 12, and the remainder of the toner is converted to a state in which it is readily removable from sheet 12 via the application of physical force.

After a predetermined time interval elapses, the top guide 46 of the refeeding deck 48 accommodating the sheet 12 to be discharged is moved to the dashed line position shown in FIG. 8A via the rotational drive of motors 466*a*–466*f* in accordance with signals output from a CPU to be described later, such that transport rollers 49 and 50 grip sheet 12 and feed the sheet 12 to belt transport section 53. In belt transport section 53, belt 56 and small-diameter grooved roller 55 are respectively rotated in accordance with the rotation of large-diameter grooved roller 54, thereby driving transport roller 58, such that sheet 12 is transported along guides 59 and 64, and is guided to the pairs of brush rollers 61 and 62. Sheet 12 is directed to the pairs of brush rollers 61 and 62 and passes therebetween such that residual toner is removed by the brush rollers. The toner stripped from sheet 12 and the toner removed by the brush rollers is circulated by circulating device 19 with the flow of deinking fluid 16, and is collected by collection device 20.

Sheet 12 is guided to guide transport path 70 of discharge section 6, and residual toner is rinsed from sheet 12 by deinking fluid 16 sprayed from nozzles 71 and 71; and the leading edge of sheet 12 is guided between intermediate rollers 72, whereupon sheet 12 is removed from deinking fluid 16 via the rotation of the intermediate rollers 72. Sheet 12 which has been removed from the deinking fluid 16 in tank 17 is subjected to the removal of deinking fluid 16 therefrom by squeeze rollers 74, and is then thermally dried in stages by drying rollers 75, 76, 77, so as to be returned to a reusable condition, whereupon the sheet 12 is discharged to discharge tray 69 by discharge roller 78.

The recovery process in the case of a jammed sheet during processing will be described hereinafter. First, fluid heater 22, drying rollers 75, 76, 77, circulation device 19 and the like are turned OFF. As shown in FIG. 2, top frame 67 is released and fluid tank 17 is lowered to the retracted position, such that the jammed sheet 12 being processed in sheet processing section 5 enters a state of non-contact with deinking fluid 16. When the jammed sheet is located in accommodating section 31, guide section 38, or refeeding section 45, an operator removes deck level 32 maintained between guide frames 30, and removes the jammed sheet. Since deck levels 32 are mounted only via connectors 37 protruding from guide frames 30, they are readily removable.

When the jammed sheet is located between refeeding section 45 and belt transport section 53, belt transport section 53 central to large-diameter grooved roller 54 is moved to the state shown in FIG. 2, and the jammed sheet is removed. When the jammed sheet is located at the pair of brush rollers 61 and 62, brush roller unit 60 is removed from guide frames 30, and the jammed sheet is removed. Since the pair of brush rollers 61 and 62 contain a large quantity of deinking fluid 16 even when removed from the deinking fluid 16, a shutter (not illustrated) may be provided on brush roller unit 60 so as to prevent dripping of deinking fluid 16 contained in brush rollers 61 and 62 when the brush rollers are removed from brush roller unit 60.

Figure 9:
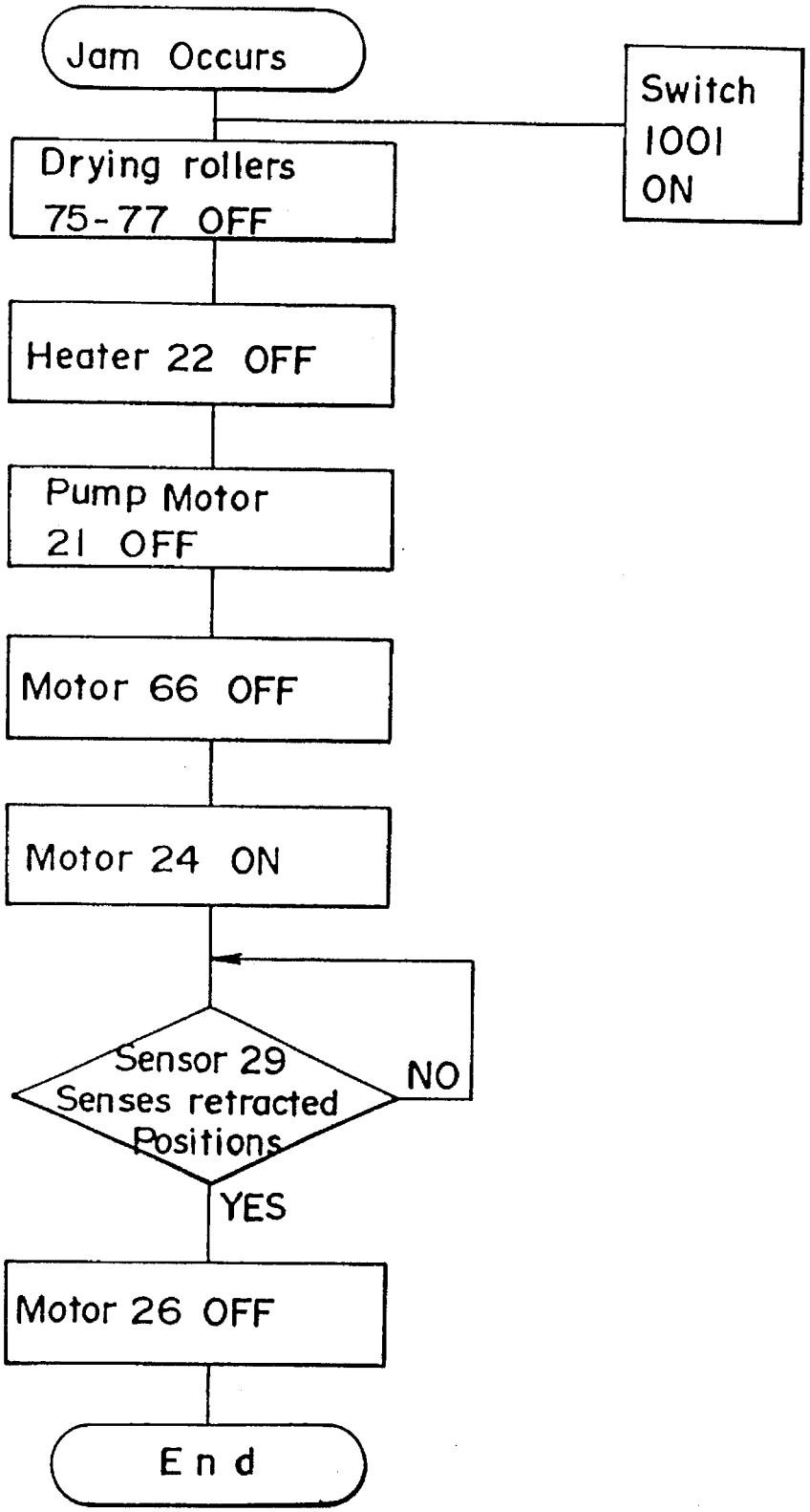
FIG. 9 is a flow chart illustrating the process for automatically lowering the fluid tank when a sheet jam occurs in the device of FIGS. 1 and 2.
Figure 16:
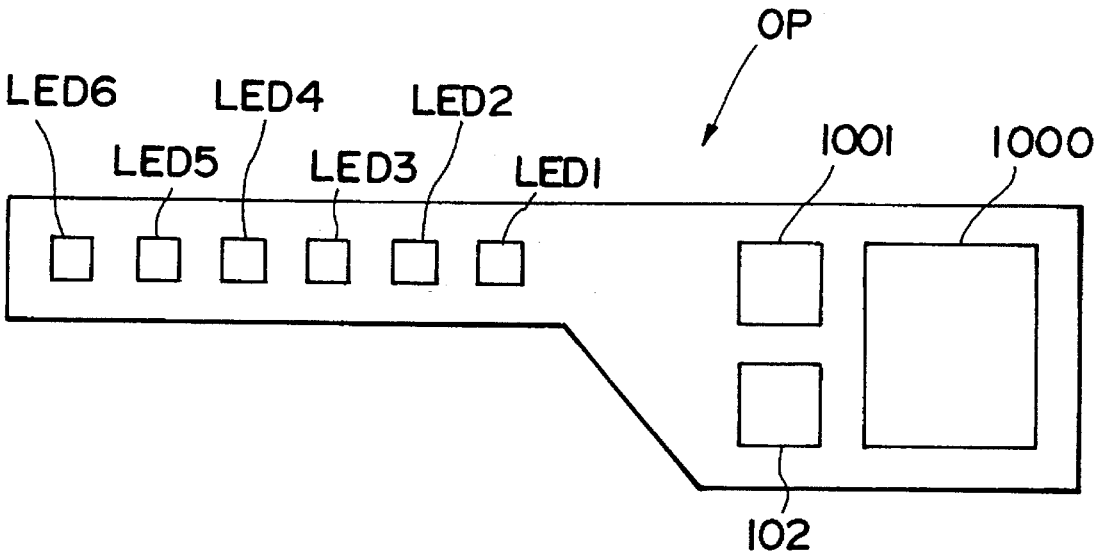
FIG. 16 illustrates an operation panel of the processing device of FIGS. 1 and 2.

When a paper jam occurs, the process for turning OFF the power source and lowering the fluid tank 17 may be automatically accomplished for recovery processing by an operator. That is, when a sheet jam is detected via signals from sensors 43, 52 and the like, a jam warning device (e.g., a flashing light emitting diode (LED) as shown in FIG. 16) can automatically alert an operator to the jam condition, who then depresses a switch 1001 for the jam process. After a jam occurs and switch 1001 is depressed, the process illustrated in FIG. 9 is carried out. Specifically, the power sources are automatically turned OFF for the heater of drying roller 75, fluid heater 22, pump 21 of circulation device 19, drive motor 66 for the various rollers and the like, motor 26 of lifting mechanism 18 is actuated to lower fluid tank 17, and the positioning of fluid tank 17 at a predetermined retracted position is confirmed by lower limit sensor 29, whereupon motor 26 is turned off and the lowering operation stops.

Figure 10:
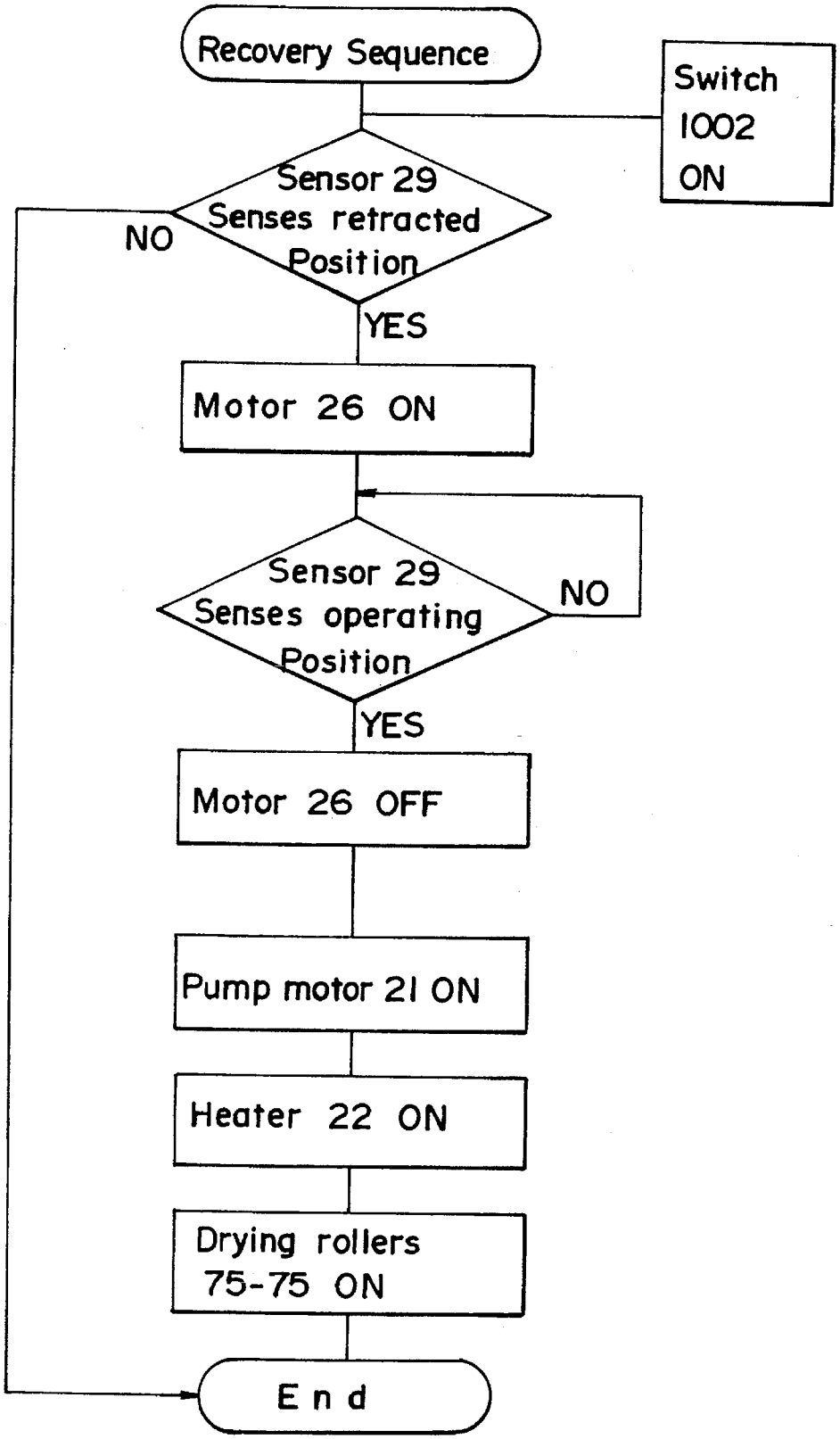
FIG. 10 is a flow chart illustrating a recovery process which follows a jam process.

The recovery operation following a jam process is shown in FIG. 10. When an operator turns ON a jam process completion switch 1002, the position of the fluid tank 17 at the retracted position is confirmed, whereupon motor 26 of lifting mechanism 18 is actuated to raise fluid tank 17. When the fluid tank 17 is raised and its attainment of a predetermined operating position (the position shown in FIG. 1) is confirmed, motor 26 of lifting mechanism 18 is turned OFF, and pump 21 of circulation device 19, fluid heater 22, and drying rollers 75 and the like are turned ON.

When a jam is detected in accommodating section 31, guide section 38, or refeeding section 45 of sheet processing section 5, i.e., when a jam is detected at a location other than along the common paths of passage of all sheets, jam processing need not be promptly executed insofar as the deck 32 in which the jam occurs can be set to an inoperative state while the other decks 32 may continue to be used for the recycling process.

The recycling process is described in detail hereinafter with reference to the flow charts of FIGS. 11–14, the block diagram of FIG. 15, and the operation panel of FIG. 16.

FIG. 16 shows operation panel OP provided on the body of device 1. When switch 1000 is turned ON, feed roller 13 is rotatably driven, and timing roller 15 is actuated synchronously with the actuation of the various brush rollers in accordance with detection by sensor 14, such that a processed sheet is ultimately ejected to discharge tray 69. Details of this process are described below. LEDs 1–6 are light-emitting elements for indicating to an operator in which deck among the various decks of device 1 a jam occurs. Switch 1001 is turned ON when device 1 enters the jam sequence (step #100), and fluid tank 17 is automatically lowered, as shown in FIG. 9. In this state, an operator can execute jam processing by opening top frame 67, as shown in FIG. 2. That is, switch 1001 is a jam process start switch. On the other hand, switch 1002 is a jam process end switch, which causes the device 1 to enter a standby state for a subsequent process by lifting fluid tank 17 when the fluid tank 17 is at a lowered position. The signal from jam process start switch 1001 does not receive input when device 1 is in a state other than in the jam processing state.

Figure 14:
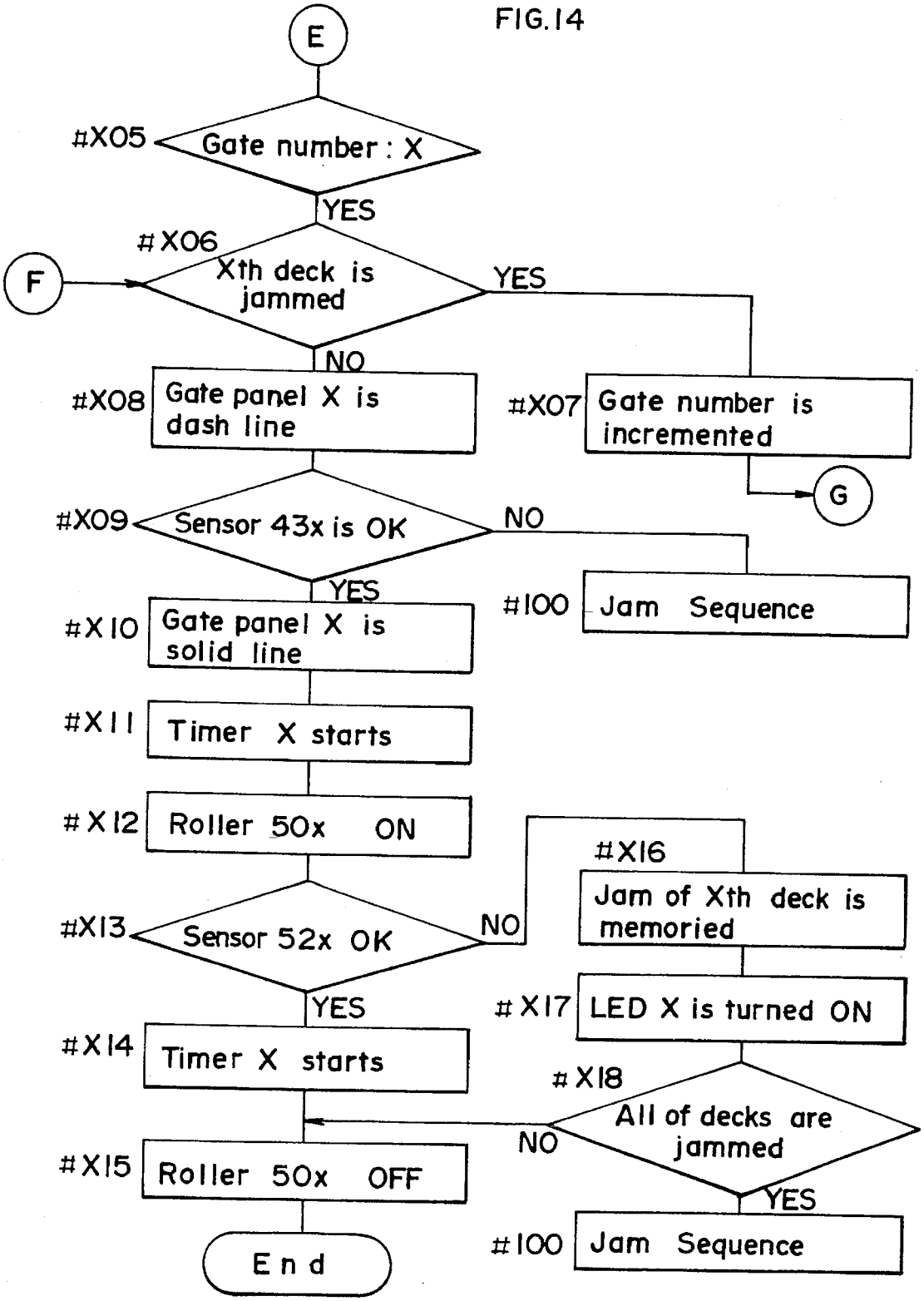
Figure 15:
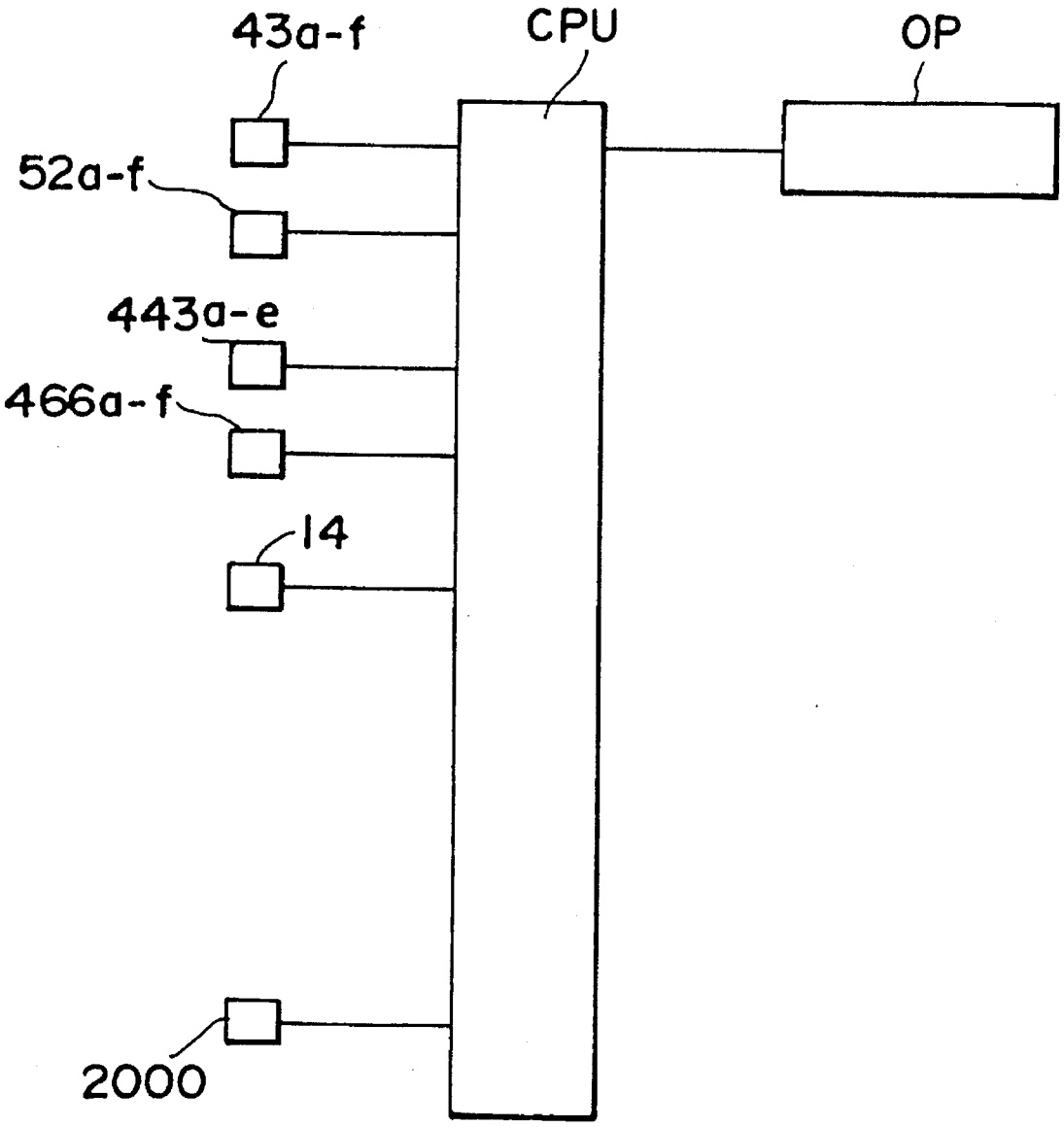
FIG. 15 is a block diagram of a control section of the processing device of FIGS. 1 and 2.

FIG. 15 is a block diagram showing the general control of device 1 based on the flow sequence shown in FIGS. 11–14 to be described later. That is, a warning of the occurrence of a jam is readily achieved by a control device CPU receiving an input from operation panel OP, or actuation (lighting) of an LED 1–6, as well as by sensors 43*a*–43*f* and sensors 52*a*–52*f* insofar as a jam of a processed sheet 12 occurs in only a single deck. However, actuation timing control is executed for motors 466*a*–466*f* to discharge a sheet 12, and to actuate motors 443*a*–443*e* to insert sheet 12 in the various decks (described later). Feed roller 13 for transporting sheet 12, sensor 14 for detecting the insertion of a sheet, timing roller 15, motor 66 for driving various rollers within sheet processing section 5 and motor 26 for raising and lowering fluid tank 17 are controlled by the CPU in accordance with the ON signal of switch 1000 from operation panel OP as shown in FIG. 15.

The CPU is also connected to various other elements of device 1, e.g., unit 2000 for controlling motor 26, and temperature regulation, and actuation of pump 21.

Specific processing flows will now be described with reference to FIGS. 11–15. In FIG. 11, motor 66 for the various transport rollers is turned ON (step #101), then the gate number is incremented for the gate of the deck accommodating a sheet (step #102). The gate number is defined as the number of the gate corresponding to each accommodating deck, e.g., gate number [1] is the gate corresponding to the uppermost deck. The incremented gate number is checked to determine whether or not the incremented gate number is greater than [X+1] wherein [1] is added to the deck number [X] (step #103). If the gate number is [X+1] or greater, the gate number is set at [1] (step #104), and a check is made to determine whether or not the gate number is [1] (step #105). On the other hand, if the gate number is less than [1], a check is made to determine whether or not the gate number prior to incrementation is [1] (step #105).

When the gate number is [1], a check is made to determine whether or not a sheet jam has occurred in the first level (uppermost level) deck (step #106). If a sheet jam has occurred in the first level deck, the gate number is incremented (step #107). If a sheet jam has not occurred in the first level deck, the first level gate 44 is set at the guide position (dashed line position in FIG. 8A), and a sheet is inserted into the first level deck (step #108). Then, a check is made to determine whether or not the trailing edge of the sheet has passed the detection position of sensor 43*a* within a predetermined time based on signals from sheet detection sensor 43*a* on the insertion side of the uppermost level (step #109). At this time, if the passage of the trailing edge of the sheet is not detected due to a sheet jam, the routine advances to the jam sequence (step #100). On the other hand, when the passage of the trailing edge of the sheet is detected, uppermost level gate 44*a* is selectably moved to the nonguide position (solid line position in FIG. 8A) via the actuation of motor 440*a* (step #110), a timer is started (step #111), and a discharge process is executed for the sheet accommodated in the deck after the timer ends (step #112). That is, transport rollers 49 and 50 are moved from the solid line position to the dashed line position in FIG. 8A, and roller 50 is rotatably driven.

When the leading edge of sheet 12 is detected by sheet detection sensor 52*a* on the refeeding side (step #113), a separate timer is started (#114), and the discharge process ends when the timer ends (#115). On the other hand, if the leading edge of sheet 12 is not detected by sensor 52, the occurrence of a sheet jam in the first level deck is stored in memory (#116), and LED 1 flashes to indicate that a sheet jam has occurred in the first level deck (#117). Then, a check is made to determine whether or not sheet jams have occurred in all decks (#118). If sheet jams have occurred in all decks, the jam sequence is started (#100), whereas if a nonjammed deck remains, the discharge process ends (#114). The discharge process is identical for gate number 1.

Figure 12:
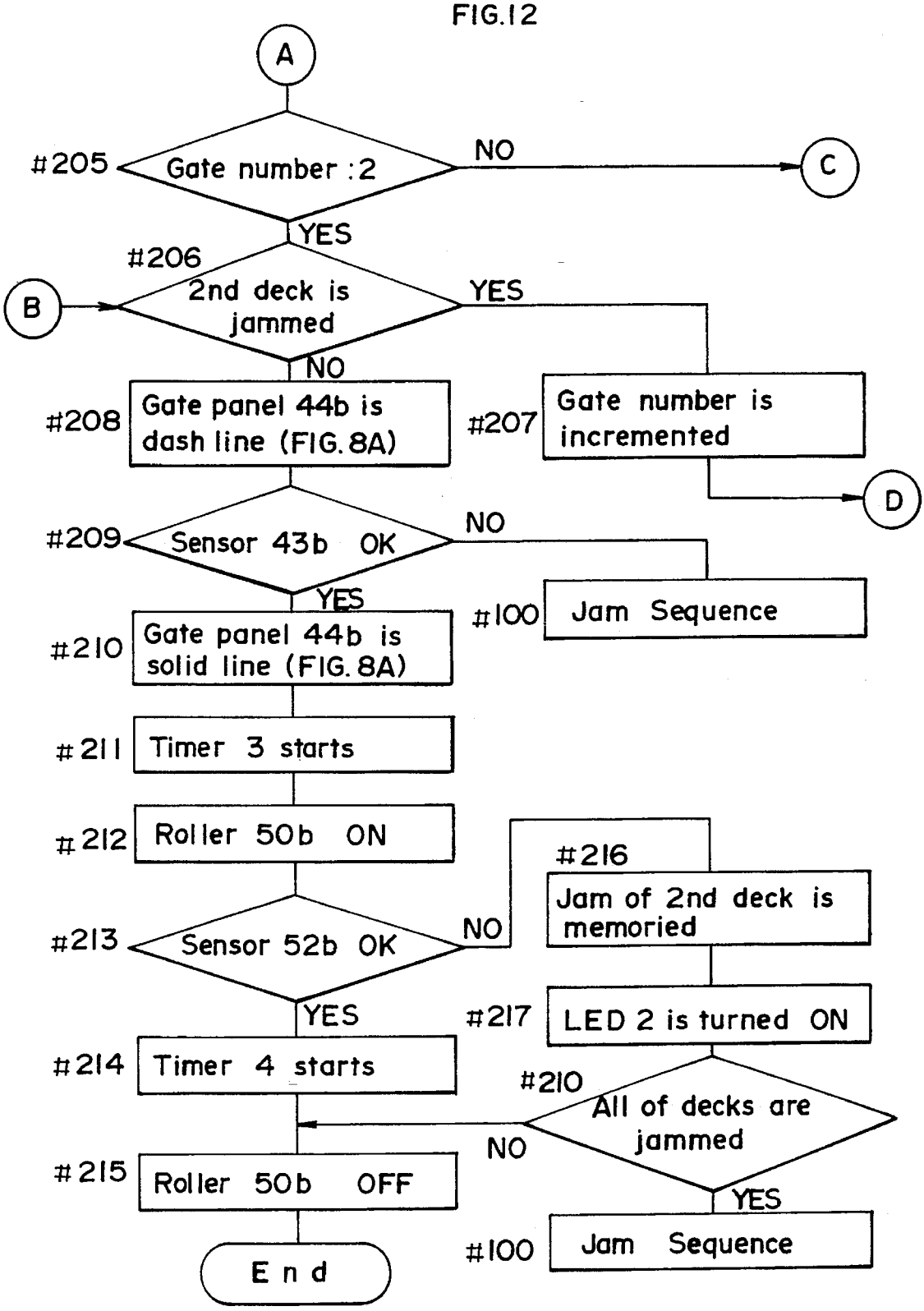

As shown in FIG. 12, when the gate number is determined to be [2] (#205), or when the gate number is incremented from [1] to [2] (#107), a check is made to determine whether or not a sheet jam has occurred in the second level deck (#206). If a sheet jam has occurred in the second level deck, the gate number is incremented (#207). On the other hand, if a sheet jam has not occurred in the second level deck, the second level deck is set at the guide position, and a sheet is guided to the second level deck (#208). Then, a check is made to determine whether or not the trailing edge of sheet 12 has passed the detection position of sensor 43*b* within a predetermined time via sheet detection sensor 43*b* disposed on the insertion side of the second level (#209). At this time, if the sheet introduced into the deck jams such that the passage of the trailing edge of sheet 12 is not detected, the jam sequence is started (#100). On the other hand, when the trailing edge of the sheet is detected, the gate panel 44*b* is selectably set at the nonguide position (#210), a timer is started (#211), and the discharge process is executed for the sheet accommodated in the deck after the timer ends (#212).

When the leading edge of sheet 12 is detected by sheet detection sensor 52*b* on the refeeding side (#213), a separate timer is started (#214), and the discharge process is started after the timer ends (#215). On the other hand, if the leading edge of sheet 12 is not detected by sensor 52*b*, the occurrence of a jam in the second level deck is stored in memory (#216), LED 2 flashes to indicate that a jam has occurred in the second level deck (#217), and a check is made to determine whether or not all decks are jammed (#218). If all decks are jammed, the jam sequence starts (#100), whereas if all decks are not jammed, the discharge process ends (#215).

Figure 13:
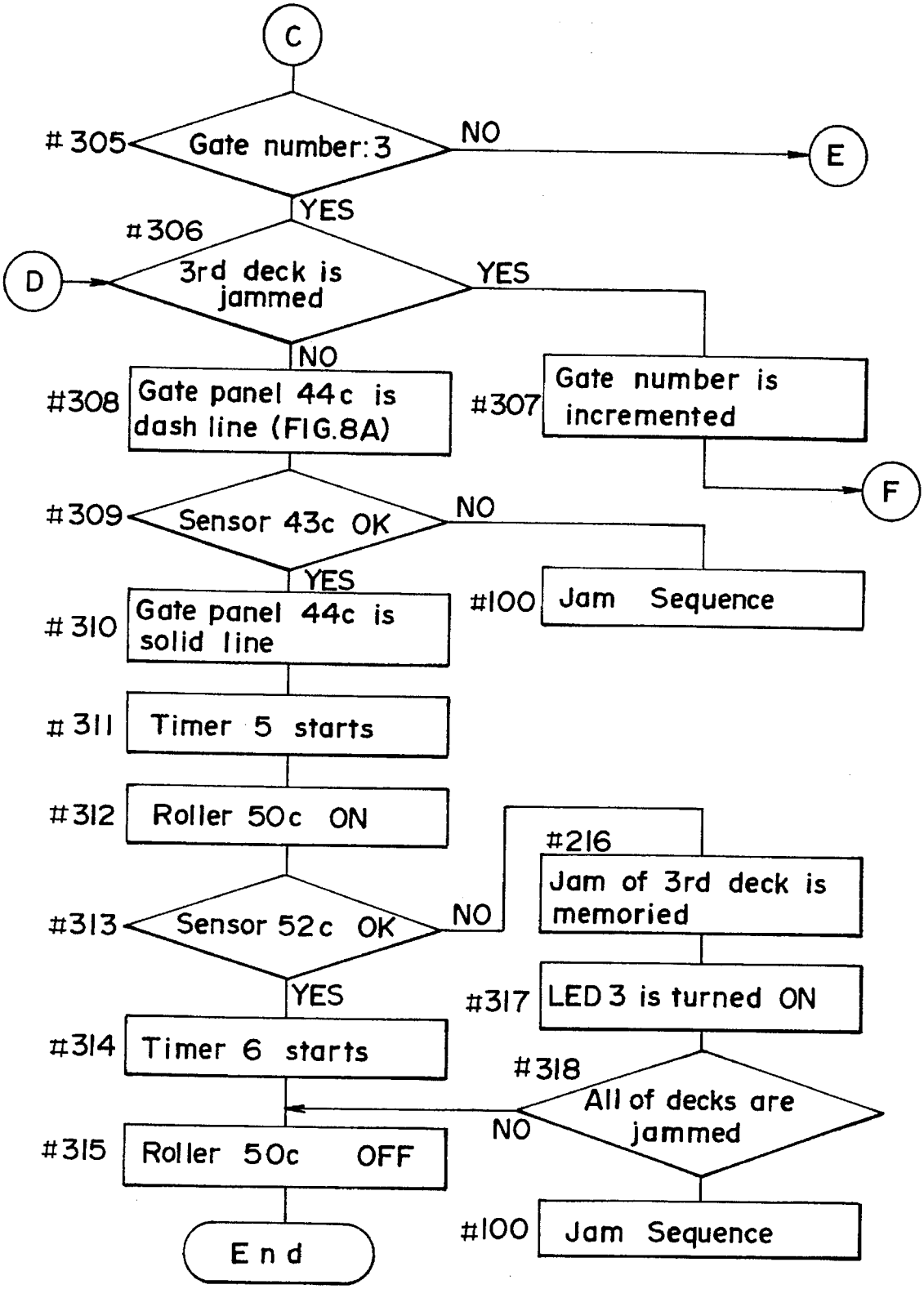

Thereafter, processes are executed corresponding to the decks from the third level to the lowermost level in a similar fashion, as shown in FIGS. 13 and 14 (steps #305 to #318 in FIG. 13 and steps X05–X18 in FIG. 14), such that sheets are sequentially processed using only decks without jammed sheets.

Figure 17:
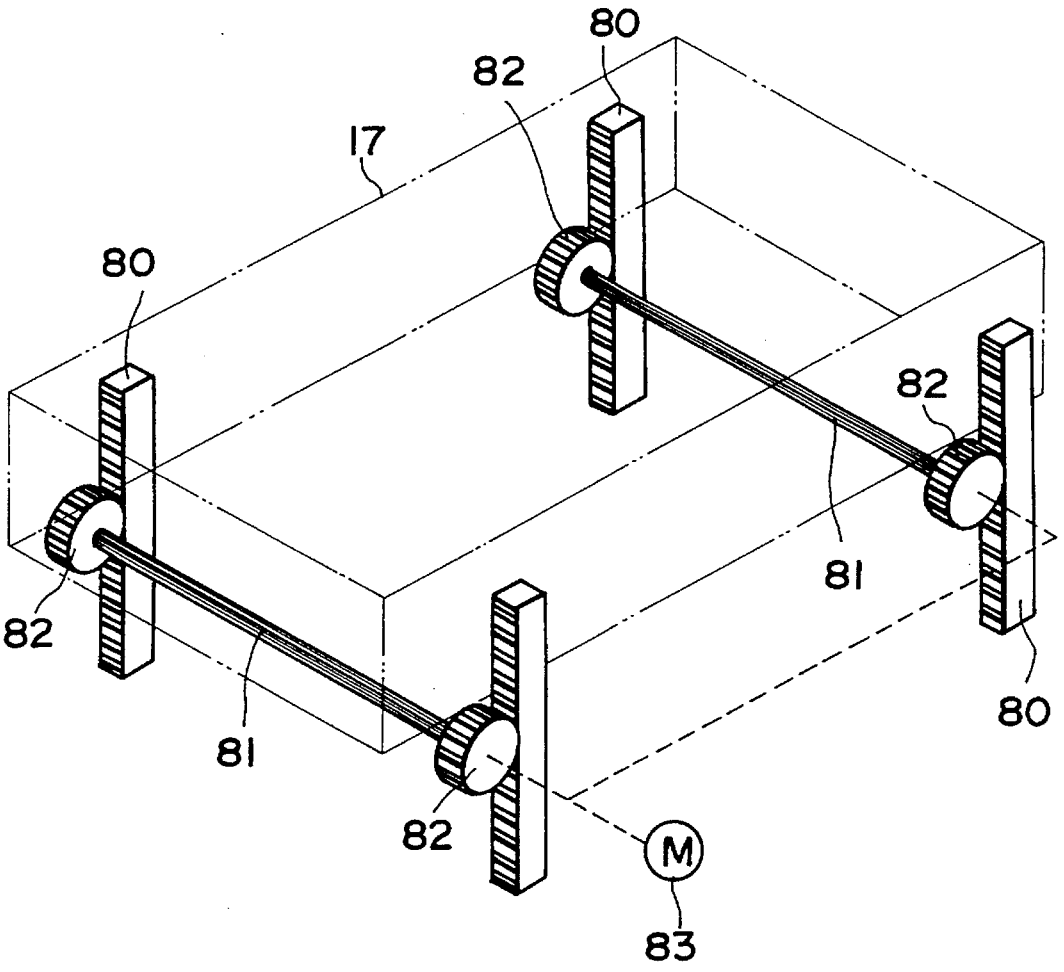
FIG. 17 is a perspective view showing another embodiment of the lifting mechanism of the fluid tank.

Lifting mechanism 18 of fluid tank 17 is not limited to the above-described embodiment, and can be varied in many ways. For example, a construction such as shown in FIG. 17 may be used comprising racks 80 provided on main frame 2, shafts 81 mounted on fluid tank 17, pinions 82 fixedly mounted on both ends of the shafts 81 so as to engage the racks 80, and a motor 83 for rotating the shafts 81.

Figure 18:
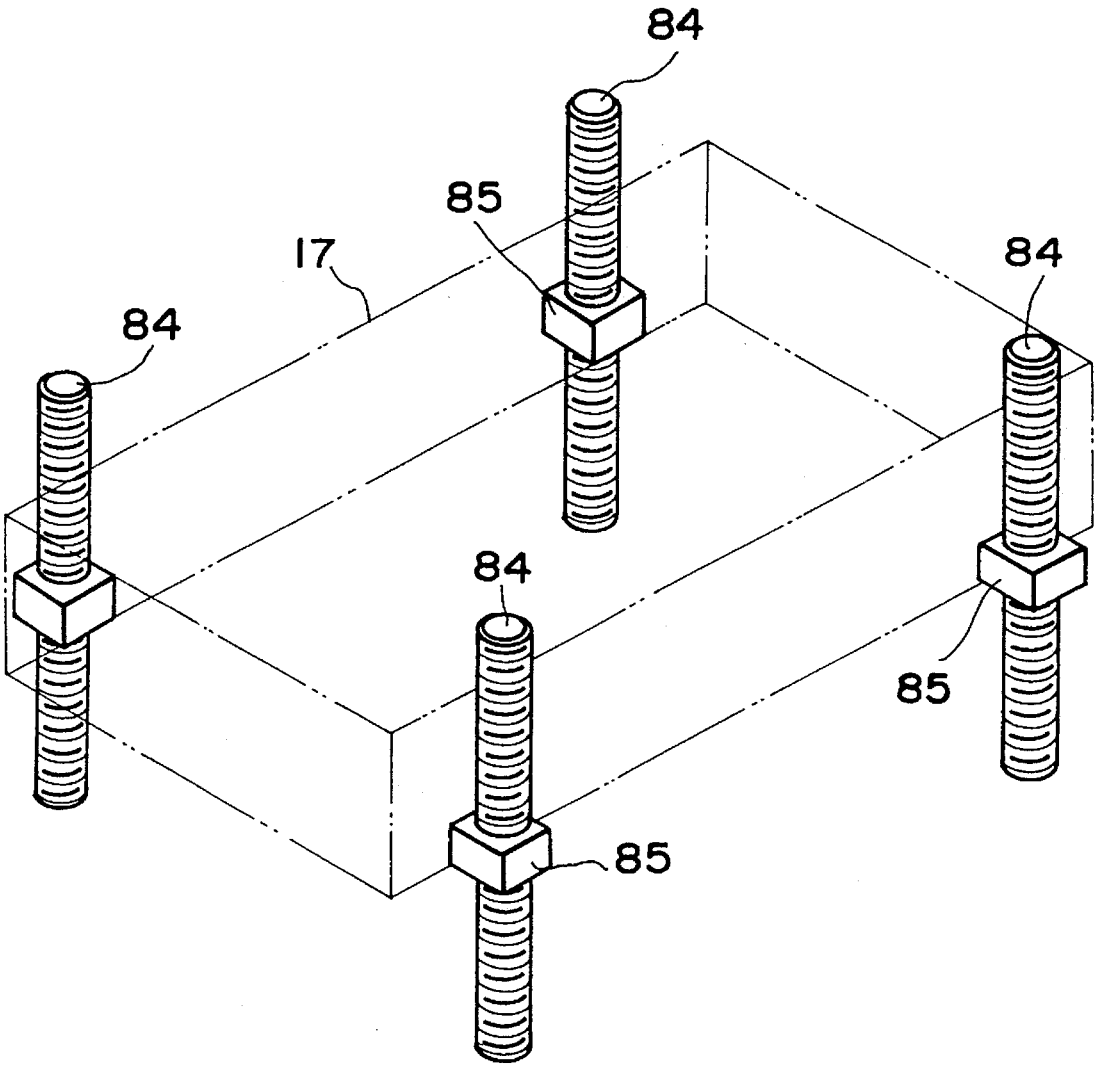
FIG. 18 is a perspective view showing still another embodiment of the lifting mechanism of the fluid tank.

Alternatively, a construction such as shown in FIG. 18 comprising screw shafts 84 provided on main frame 2 so as to be freely rotatable, and fixedly mounted screws 85 mounted on fluid tank 17 which engage the screw shafts 84, such that fluid tank 17 can be raised and lowered by rotation of the screw shafts in conjunction with a drive force supplied by a motor (not shown) can also be employed.

Furthermore, a handle may be provided to raise and lower the tank manually without using a motor.

Figure 19:
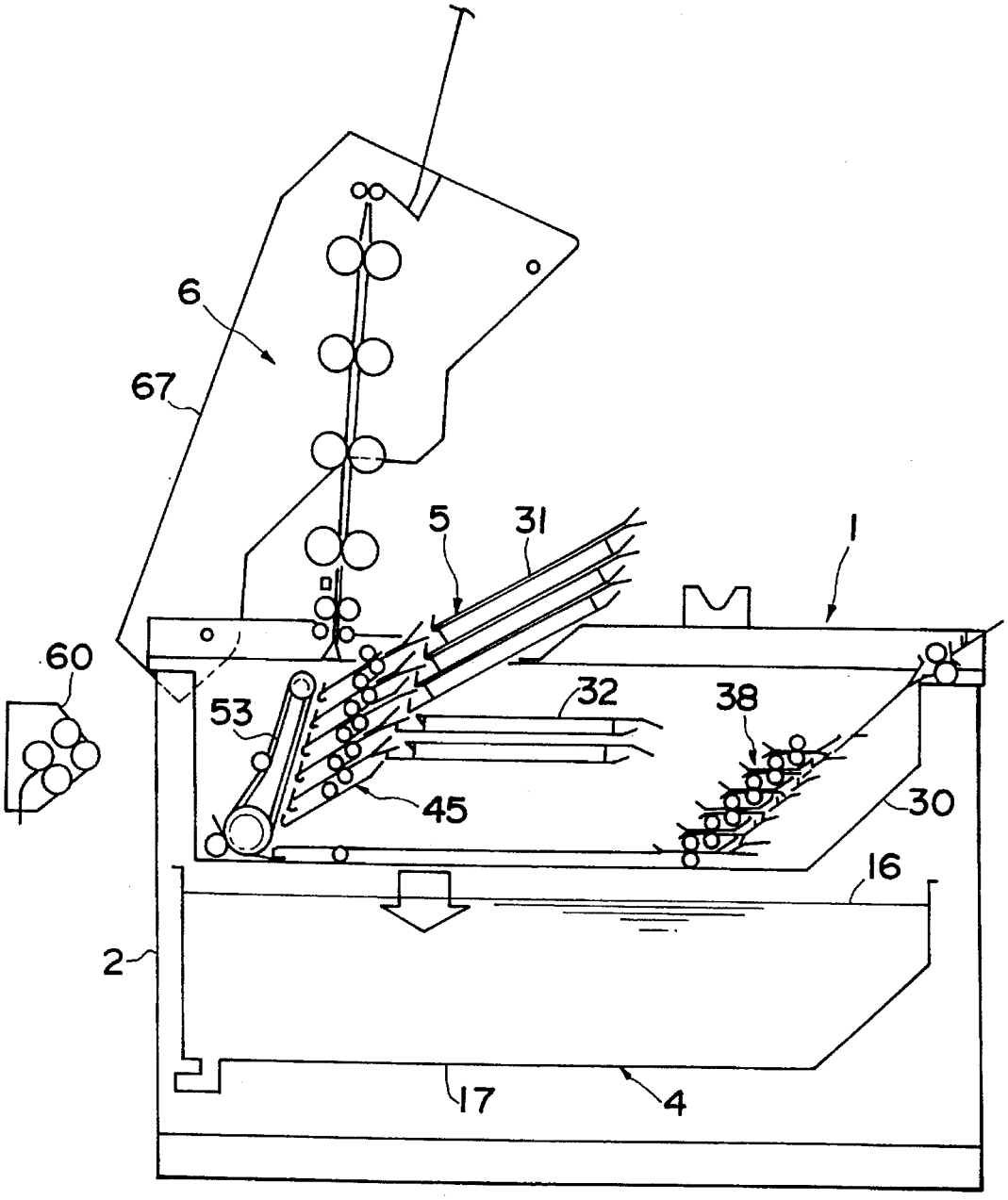
FIG. 19 is a sectional view showing a processing device with the sheet accommodating section and refeeding section integratedly formed with a belt transport section according to a further embodiment of the present invention.

In the above-described embodiment, each deck of accommodating section 31 is constructed so as to be removable therefrom, but another possible construction is shown in FIG. 19 wherein accommodating section 31 and refeeding section 45 are connected so as to be integratedly oscillatable with belt transport section 53, such that a predetermined angular rotation is possible relative to refeeding section 48 corresponding to each deck 32.

Figure 20:
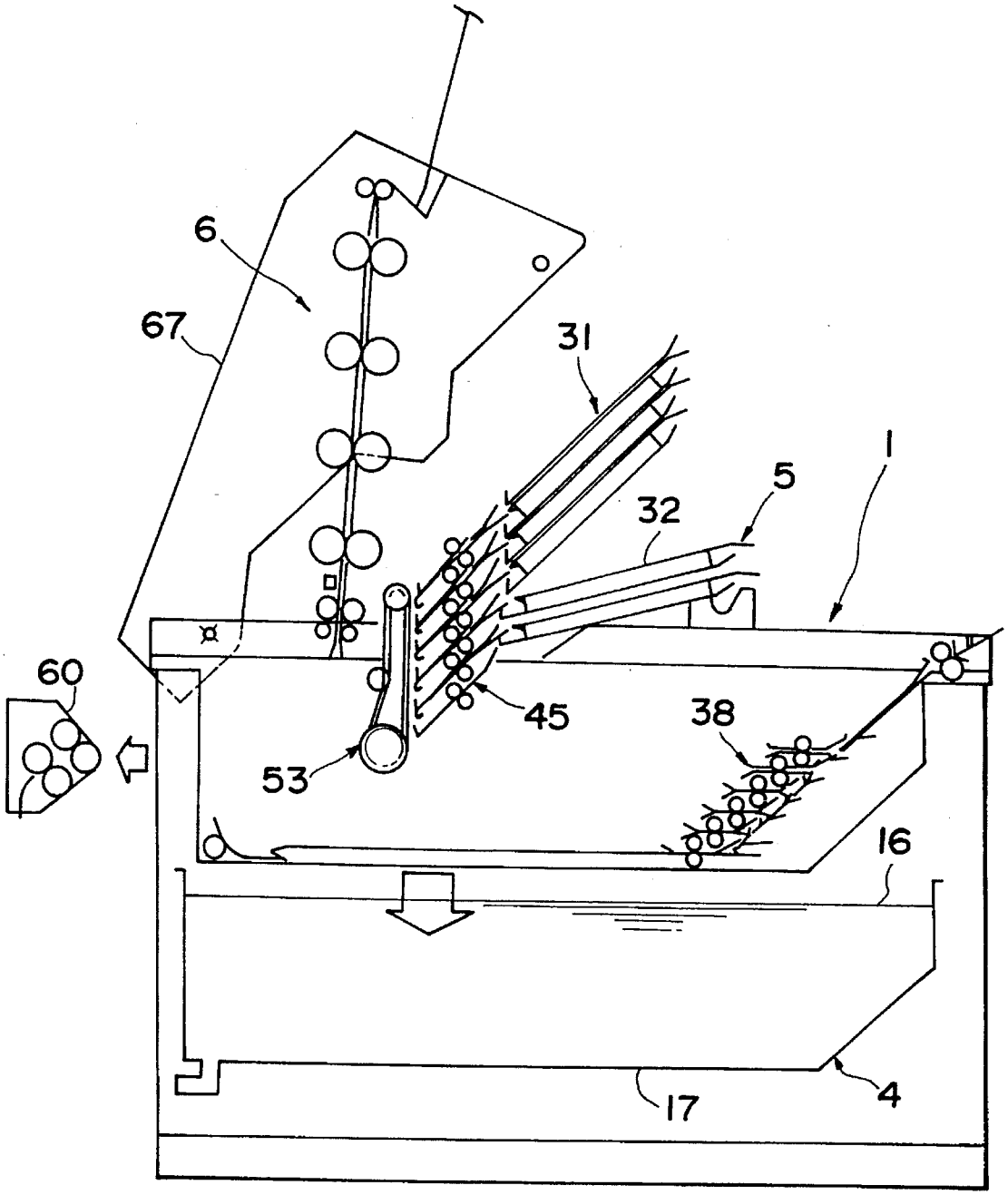
FIG. 20 is a sectional view showing a processing device wherein the sheet accommodating section, refeeding section, and belt transport section operate in conjunction with the opening of a top frame of the device according to yet a further embodiment of the present invention.

As shown in FIG. 20, belt transport section 53, refeeding section 45, and accommodating section 31 may be constructed so as to be vertically movable in conjunction with the opening of top frame 67, such that a predetermined angular rotation is possible relative to refeeding section 45 corresponding to each deck 32. Thus, jammed sheets can be readily removed.

Figure 21:
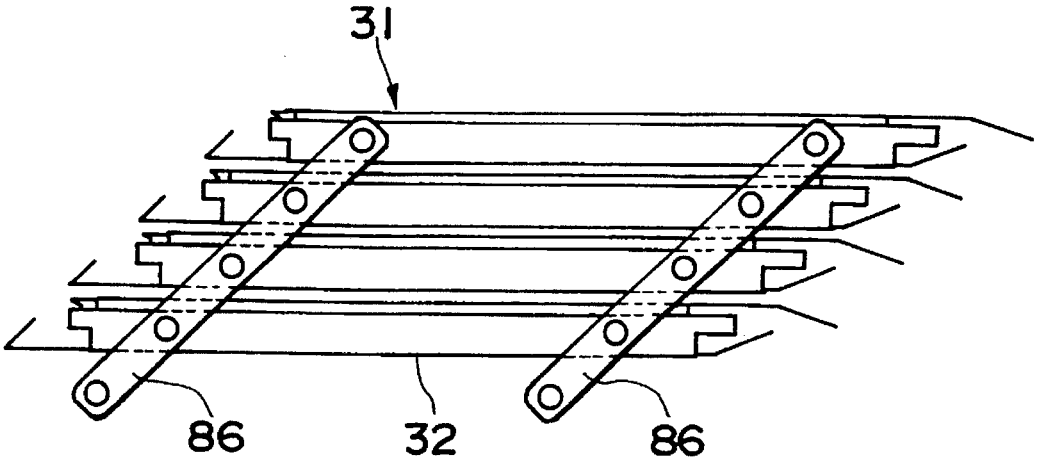
FIG. 21 is a side view showing another embodiment of the sheet accommodating section.
Figure 22:
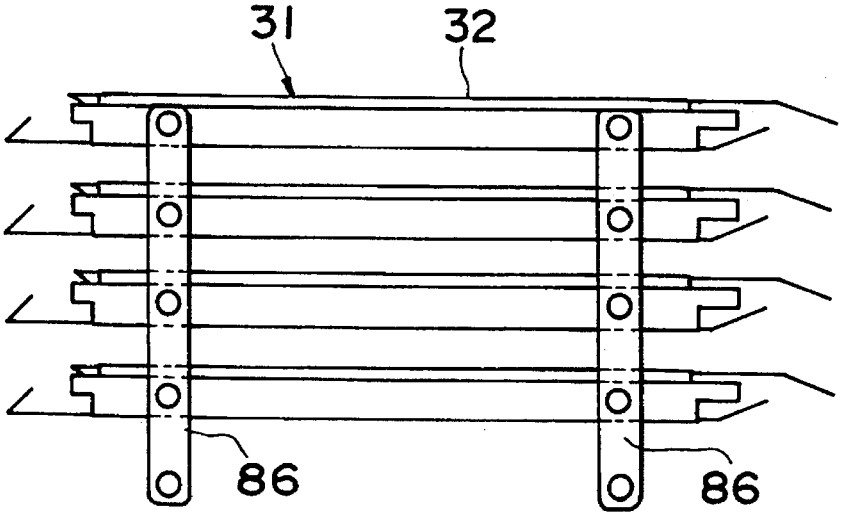
FIG. 22 is a side view showing the operation of the sheet accommodating section of FIG. 21.
Figure 23:
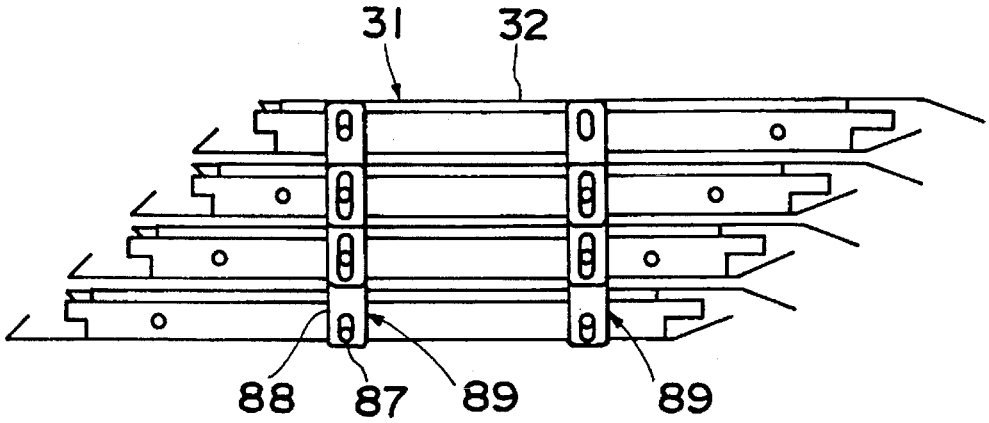
FIG. 23 is a side view showing still another embodiment of the sheet accommodating section.
Figure 24:
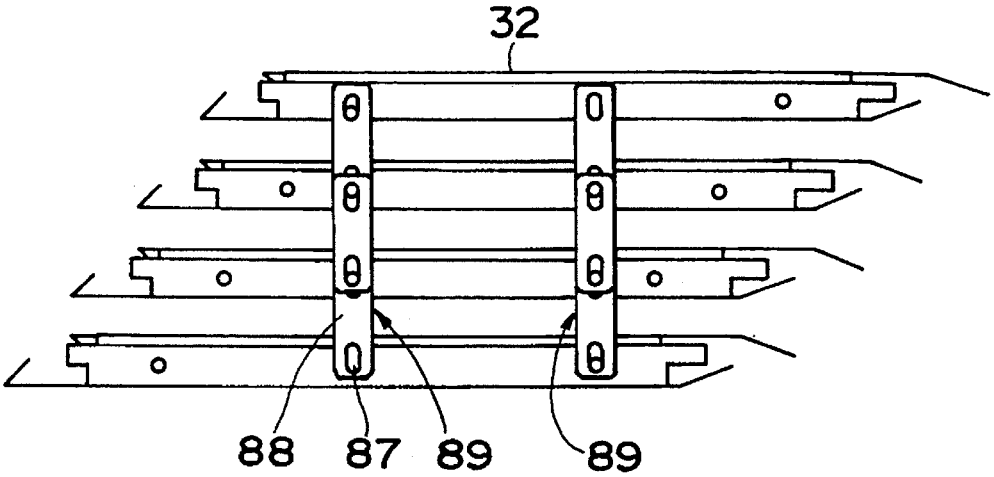
FIG. 24 is a side view showing the operation of the sheet accommodating section of FIG. 23.

As shown in FIGS. 21 and 22, a bilateral section of stacked decks 32 may be connected to a plurality of rotatable members 86 and 86 disposed in an inclined arrangement so as to be freely rotatable, such that the spacing between the decks can be increased by oscillating the members 86. As shown in FIGS. 23 and 24, stacked decks 32 may be connected to telescoping members 89 comprising a plurality of members 88 formed with slots 87 oriented in a vertical direction, such that the sheet accommodating compartments of random decks 32 may be individually widened.

Figure 25:
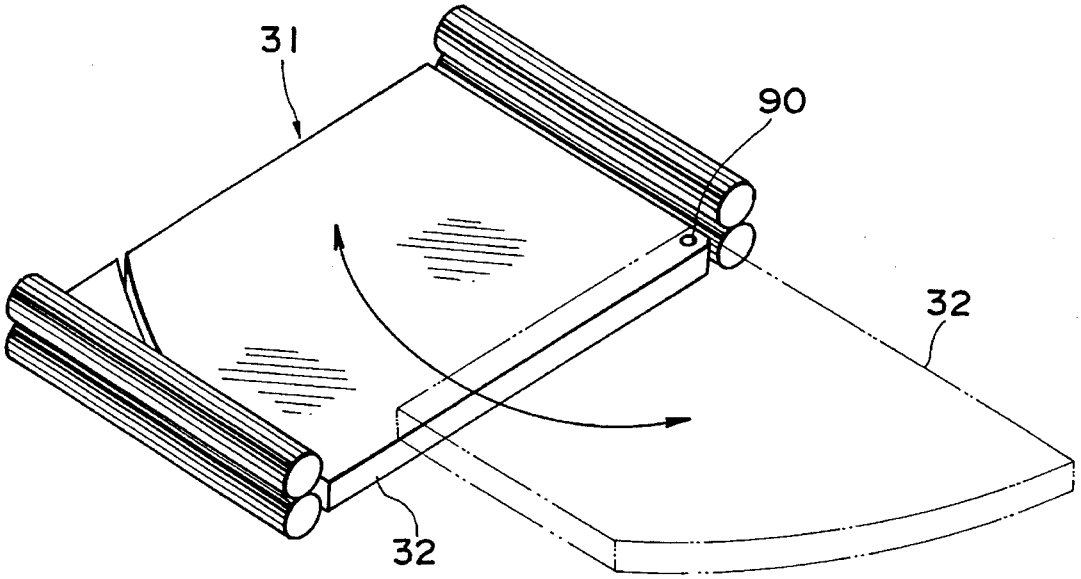
FIG. 25 is a perspective view of another embodiment of the present invention wherein the decks are rotatable on the operating side.
Figure 26:
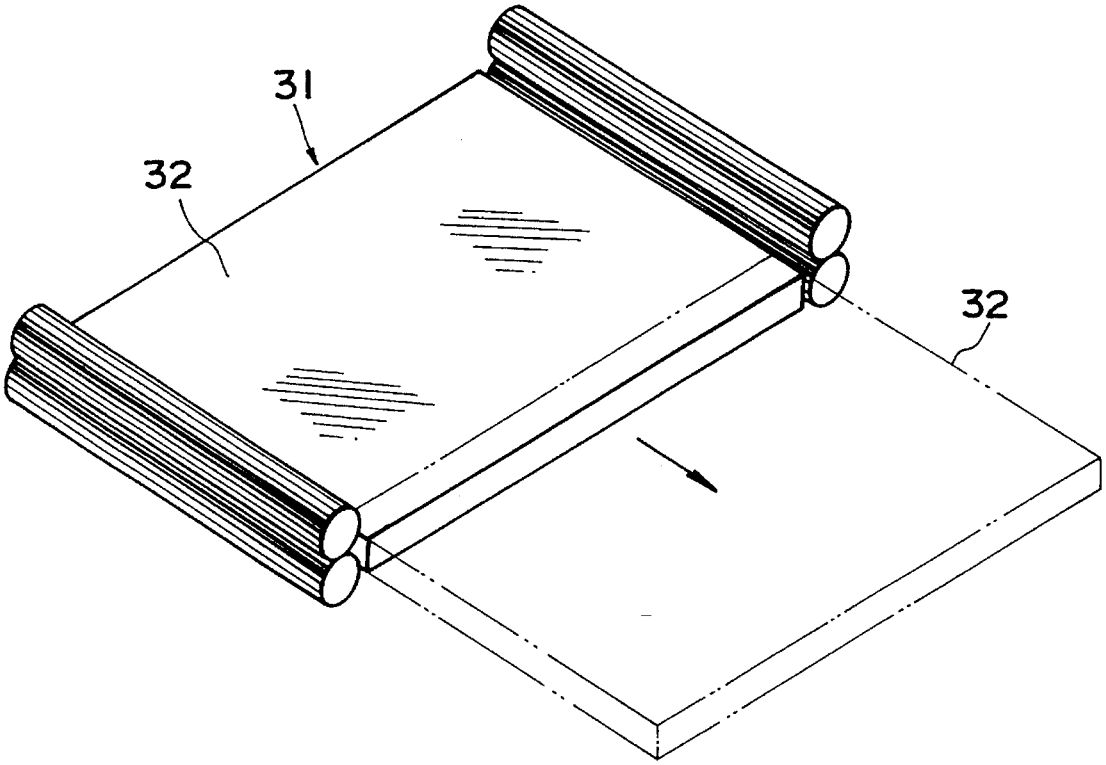
FIG. 26 is a perspective view showing still another embodiment of the present invention wherein the decks are removable on the operating side.

As shown in FIG. 25, each deck 32 may also be rotated to the operating side about a shaft 90 provided at a corner of the operating side. Furthermore, each deck 32 may be pulled to the operating side, as shown in FIG. 26.

The deinking fluid 16 will now be described in greater detail. The deinking fluid functions to remove ink on a printed surface which is rendered visible by a printing material including at least a resin on a recording media such as a copy sheet. Deinking fluids are typically produced as required with various constituents including (1) constituents which dissolve or swell resins of printing materials; (2) constituents which act to flocculate printing materials after deinking so as to prevent deinked printing material from again adhering to the paper; (3) constituents which swell fibers of paper, which is one type of recording media, so as to render printing materials in a state wherein they are easily removable from the paper fibers; and (4) constituents which increase permeation of deinking fluid to printing material and paper, so as to shorten the time for deinking. Examples of organic solvents useable as constituents for dissolving or swelling the resin of a printing material include dihydric organic monoesters, glycol ether and the like.

Examples of useable dihydric organic monoesters include dihydric organic acids of dihydric organic monoesters including saturated and unsaturated fatty acids such as, for example, oxalic acid, malonic acid, succinic acid, glutoric acid, adipic acid, pimelic acid, suberic acid, azelaic acid, sebacic acid, maleic acid, or fumaric acid; aromatic fatty acids such as, for example, phthalic acid, isophthalic acid, and terephthalic acid. Among the aforesaid acids, saturated fatty acids such as oxalic acid, malonic acid, succinic acid, glutoric acid, adipic acid, pimelic acid, suberic acid, azelaic acid, and sebacic acid are most useful.

Examples of useful alcohol constituents of dihydric organic monoesters include, for example, dihydric alcohols (may be either normal chain or branching chain) such as methanol, ethanol, propanol, butanol, pentanol; polyhydric alcohols such as ethylene glycol, glycerine, pentaerythritol, and sorbitol; glycols such as diethylene glycol, dipropylene glycol, and polyethylene glycol, and cellosolves such as ethyl cellosolve, and butyl cellosolve. The aforesaid alcohols may be used singly or in combinations of two or more of the alcohols.

Dihydric organic monoesters may be produced by esterification reaction of the aforesaid dihydric organic acids and alcohols, or by hydrolytic reaction of dihydric organic diesters.

$$HOOC—(CH_2)_n—COOR_1 \qquad \text{(Formula 1)}$$

(In Formula 1, R1 represent an alcohol radical of 1–5 carbon chains; and n represents an integer of 0–8.)

Specifically, the following may be used:
oxalic acid monoester ($HOOC—COOR_1$),
melanic acid monoester ($HOOC—CH_2—COOR_1$),
succinic acid monoester ($HOOC—(CH_2)_2—COOR_1$),
glutaric acid monoester ($HOOC—(CH_2)_3—COOR_1$),
adipic acid monoester ($HOOC—(CH_2)_4—COOR_1$),
pimelic acid monoester ($HOOC—(CH_2)_5—COOR_1$),
subaric acid monoester ($HOOC—(CH_2)_6—COOR_1$),
azelaic acid monoester ($HOOC—(CH_2)_7—COOR_1$),
sebacic acid monoester ($HOOC—(CH_2)_8—COOR_1$).

Of course, the aforesaid dihydric organic monoesters may be used singly or in combinations of two or more.

Dihydric organic monoesters are water compatible, and can swell paper fibers of recording media via the presence of carbonic acid radical, thereby rendering the printing material in a state wherein it is readily removable from the paper fibers, and have excellent permeation relative to printing material and maintain solvent power and swelling of toner by the presence of ester radicals.

In the total deinking fluid, the amount of additive should be within a range of 5–60 percent-by-weight, and ideally 20–40 percent-by-weight. When the amount of additive is less than 5 percent-by-weight, swelling and dissolvability relative to the printing material deteriorates and there is no deinking effect. When the amount of additive is over 60 percent-by-weight, dissolvability relative to the printing material is excessive, such that it again adheres to the paper.

Examples of useful glycol ethers include, for example, ethylene glycol monoethyl ether, ethylene glycol monoisopropoyl ether, ethylene glycol monobutyl ether, ethylene glycol monoisoamyl ether, diethylene glycol monoethyl ether, diethylene glycol monoether, diethylene glycol monobutyl ether, triethylene glycol monomethyl ether, dipropylene glycol monomethyl ether, dipropylene glycol monoethyl ether, tripropylene monomethyl ether and the like. The aforesaid glycol ethers may be used singly or in combinations of two or more thereof.

Glycol ethers possess permeability relative to paper. In the total deinking fluid, the amount of additive should be within a range of 5–95 percent-by-weight, and ideally 10–80 percent-by-weight. When the amount of additive is less than 5 percent-by-weight, swelling and dissolvability relative to the printing material deteriorates and there is no deinking effect. When the amount of additive is over 95 percent-by-weight, dissolvability relative to the printing material is excessive, such that it again adheres to the paper.

Examples of other useful organic solvents include those which dissolve or swell the toner but which are not water compatible, for example, benzene, toluene, xylene, dichloromethane, methylethyl ketone, methyl acetate, ethyl acetate, ethyl ether, propyl ether, butyl ether, diisobutyl ketone, butyl acetate, ethylbutyl acetone, methyl propionate, ethyl propionate and the like. The aforesaid organic solvents may be used singly or in combinations of two or more thereof.

In the total deinking fluid, the amount of additive should be 10–70 percent-by-weight, and ideally 20–60 percent-by-weight. When the amount of additive is less than 10 percent-by-weight, swelling and dissolvability relative to the printing material deteriorates and there is no deinking effect. When the amount of additive is over 70 percent-by-weight, dissolvability relative to the printing material is excessive, such that it again adheres to the paper.

A constituent having a flocculating n action relative to printing materials, such as toner or the like, after deinking may be used to prevent re-adhesion of the deinked printing material on the paper. Examples of such constituent include surface-active agents, higher fatty acids, and higher fatty acid esters.

Examples of useful surface-active agents include anionic surface-acting agents, nonionic surface-active agents, cationic surface-active agents, and ampholytic surface-active agents. Conventionally, surface-active agents have been used as deinking agents for pulped wastepaper, but in the case of resin-type printing materials, the deinking effect was extremely weak when used in the present invention, even when surface-active agents were used individually in direct contact with the recording media, such that the inclusion of resin swelling or dissolving constituents is desirable.

Examples of useful anionic surface-active agents include fatty acid salts, alkylsulfuric acid ester salts, alkylbenzenesulfonic acid salts, alkylnapthalene-sulfonic acid salts, alkylsulfonic-succinic acid salts, alkyldiphenyl ester disulfonic acid salts, alkylsufonic acid-succinic acid salts, napthalene-sulfonic acid-formalene condensate, polycarbonic acid copolymer surface-active agents and the like.

Examples of useful nonionic surface-active agents include polyoxyethylene alkyl ester, polyoxyethylene alkyl allyl esters, oxyethylene-oxypropylene copolymer, sorbitan fatty acid ester, polyoxyethylene-sorbitan fatty acid ester, polyoxyethylene alkyl amino and the like.

Examples of useful cationic surface-active agents or ampholytic surface-active agents include alkylamino salt, quaternary ammonium salt, alkyl betaine, amino oxide and the like. The aforesaid surface-active agents may be used singly or in combinations of two or more. Particularly desirable surface-active agents are nonionic surface-active agents of the ethylene oxide type having the chemical formula $RO(CH_2CH_2O)_nH$ (where R represents an alkyl radical or alkylphenyl radical, and n represents an integer 1–10).

Surface-active agents envelope deinked printing materials, so as to prevent their being re-adhered to the recording media. When the recording media is a common paper, the printing material is enveloped by introduction into the fiber structure of the paper, so as to easily deink printing material which has penetrated deeply into the fibers. Furthermore, fluids which swell or dissolve printing material are insoluble in water, such that when water is used as a deinking agent, safe oil-in-water (O\W) type emulsion of deinking fluid may be useful.

In the total deinking fluid, the amount of additive should be in a range of 0.1–10 percent-by-weight, and ideally 0.5–5 percent-by-weight. When the amount of additive is less than 0.1 percent-by-weight, the aforesaid effectiveness is difficult to obtain, and when the amount of additive is over 10 percent-by-weight, excessive bubbles form, making handling difficult.

Examples of useful higher fatty acids include caprylic acid, caprilic acid, lauric acid, myristic acid, palmitic acid, stearic acid, oleic acid, ricinoleic acid, linoleic acid, eleostearic acid, arachidic acid, arachidonic acid, behenic acid, erucic acid, abietic acid, rosin acid, coconut oil, linseed oil, tallow oil, tallow fatty acids, phyleic acid and the like.

Examples of higher fatty acid esters include hydroxy compounds of the aforesaid higher fatty acids, for example, alcohols such as methylalcohol, ethyl alcohol, propyl alcohol, butyl alcohol and the like, and polyhydroxy alcohols such as ethylene glycol, glycerine, pentaerythritol, sorbitol, diethylene glycol, dipropylene glycol and the like.

Higher fatty acids and higher fatty acid esters are used to flocculate printing material after deinking so as to prevent re-adhesion of the printing material to the recording media. In the total deinking fluid, the amount of additive should be in a range of 5–96 percent-by-weight, and ideally 20–80 percent-by-weight. When the amount of additive is less than 5 percent by weight, the flocculation effectiveness is reduced, and when the amount of additive is over 95 percent-by-weight, effectiveness of the fluid to dissolve and swell the printing material is reduced.

Water is a constituent capable of swelling fibers of paper, which is one type of recording media, and of rendering printing material in a state wherein it is easily stripped from paper fibers. In the total aqueous deinking fluid of water, the amount of additive should be in a range of 1–90 percent-by-weight, and ideally 30–80 percent-by-weight. When the amount of water used exceeds 90 percent-by-weight, paper fibers are damaged, and excessive drying is necessitated after deinking. When the amount of added water is less than 1 percent-by-weight, the effect of expanding the paper fibers is not obtained, such that the deinking fluid does not adequately permeate the interior regions of the paper. Suitable amounts of water additive are determined by the type of fluid used for dissolving or swelling the resin.

Organic acids are constituents which increase the permeability of the deinking fluid relative to printing material and paper, and which reduce the time required for deinking. Examples of useful organic acids include saturated aliphalic carbonic acids such as formic acid, acetate, propionic acid butyric acid, valeric acid, pimelic acid, caproic acid, caprylic acid, capric acid, lauric acid, myristic acid, palmitic acid, stearic acid and the like; unsaturated aliphalic carbonic acids such as acrylic acid, propionic acid, methacrylic acid, crotonic acid, oleic acid, renolic acid, erucic acid, ricinoleic acid, abietic acid, resin acid, or aromatic carbonic acids such as benzoic acid, toluic acid, naphthoic acid, cinnamic acid, 2-furfural, nicotinic acid, isonicotinic acid and the like. The aforesaid organic acids may be used singly or in combinations of two or more. Among the aforesaid organic acids, the most useful are higher fatty acids such as lauric acid, myristic acid, palmitic acid, stearic acid, oleic acid, renolic acid, erucic acid, ricinoleic acid, abietic acid and resin acid. Oils such as palm oil, linseed oil, tallow, and whale oil containing the aforesaid higher fatty acids are also useful.

Organic acids preferably comprise 1–10 percent-by-weight of the total deinking fluid. The workings of the organic acids in the deinking action in the present invention is not necessarily clear, however, their addition is believed to improve permeability of the deinking fluid relative to toner and paper and the like, to reduce the time required for deinking, and to generally improve overall effectiveness.

It is to be understood that, for example, methanol, ethanol, n-butanol, isopropanol, ethoxyethanol and the like may be added to the deinking agent of the present invention insofar as such addition does not harm the effectiveness of the invention.

The orientation modes of the respective constituents to easily and effectively achieve deinking have been described by examples such as (dihydric organic acid monoesters, organic acids, surface-active agents, water), (glycol ester solvents, higher fatty acids and/or higher fatty acid esters, surface-active agents, water), (organic solvents, surface-active agents, water). It is to be understood, however, that the present invention is not limited to the above examples, nor to the preferred embodiments of the processing device described herein. Because the present invention can be varied in many ways, it should be recognized that the invention should be limited only insofar as is required by the scope of the following claims.

We claim:

1. A processing device comprising:

a tank accommodating a fluid therein;

sheet feeding means for feeding a sheet into the fluid in the tank;

a sheet accommodating device for accommodating a sheet;

sensing means for outputting a signal responsive to a state of the sheet in the sheet accommodating device; and changing means for changing a relative position between the tank and the sheet accommodating device, the relative position including a retracted position where the sheet accommodating device is positioned outside the tank and an operating position where the sheet accommodating device is positioned within the fluid in the tank, the changing means changing the relative position in response to the signal outputted by the sensing means.

2. A processing device as claimed in claim 1, further comprising:

a rotating brush disposed in the fluid in the tank when the sheet accommodating device is in the operating position; and transporting means for transporting sheets sequentially from the sheet accommodating device to the rotating brush to clean a surface of the sheets.

3. A processing device as claimed in claim 1, wherein said sheet accommodating device includes a plurality of chambers for receiving sheets, and wherein said processing device further comprises guide means for guiding sheets from the sheet feeding means to the plurality of chambers of the sheet accommodating device.

4. A processing device as claimed in claim 3, further comprising controlling means for controlling the guide means to inhibit sheets from entering a chamber sensed by the sensing means to include a sheet having a predetermined state.

5. A processing device as claimed in claim 1, wherein the changing means comprises:

a connecting member fixed to the tank;

a first wheel;

a second wheel arranged to be above the first wheel;

a chain supported between the first wheel and the second wheel and being connected to the connecting member; and a motor for driving one of said wheels to drive said chain whereby the tank is vertically moved between the retracted position and the operating position.

6. A processing device as claimed in claim 1, wherein the changing means comprises:

a rotating screw shaft;

a screw engaging the rotating screw shaft and fixed to the tank; and a motor for rotating the screw shaft, whereby the tank is moved between the retracted position and the operating position in response to rotation of the screw shaft.

7. A processing device as claimed in claim 1, wherein the sheet accommodating device comprises:

a side frame having a plurality of connector members; and a plurality of panels detachably engaged to the plurality of connector members wherein each of the panels forms a portion of one of the chambers.

8. A processing device comprising:

a tank accommodating a cleaning liquid therein;

transporting means for transporting a sheet from outside of the tank into the cleaning liquid in said tank;

an accommodating unit including a plurality of chambers, each chamber including means for receiving a transported sheet and for retaining a transported sheet for a predetermined period of time;

sensor means for determining a status of the sheet in the accommodating unit and for outputting a signal indicative of the status; and changing means for changing a position of the accommodating unit relative to the tank, said relative position including a retracted position where the accommodating unit is positioned outside of the cleaning liquid and an operating position where the accommodating unit is positioned in the cleaning liquid, said changing means changing the relative position in response to the signal outputted by said sensor means.

9. A processing device as claimed in claim 8, wherein said cleaning liquid comprises a deinking liquid for removing printed material from the sheet.

* * * * *